US007522857B2

(12) United States Patent
Hasegawa et al.

(10) Patent No.: US 7,522,857 B2
(45) Date of Patent: Apr. 21, 2009

(54) TONER, IMAGE FORMING APPARATUS USING THE SAME AND PROCESS CARTRIDGE

(75) Inventors: Kumi Hasegawa, Numazu (JP); Mitsuo Aoki, Numazu (JP); Hyo Shu, Mishima (JP); Minoru Masuda, Numazu (JP); Tomoko Utsumi, Ebina (JP)

(73) Assignee: Ricoh Company, Ltd., Tokyo (JP)

( * ) Notice: Subject to any disclaimer, the term of this patent is extended or adjusted under 35 U.S.C. 154(b) by 464 days.

(21) Appl. No.: 11/227,178

(22) Filed: Sep. 16, 2005

(65) Prior Publication Data

US 2006/0063092 A1 Mar. 23, 2006

(30) Foreign Application Priority Data

Sep. 17, 2004 (JP) ..... 2004-272350

(51) Int. Cl.
*G03G 9/00* (2006.01)
*G03G 15/00* (2006.01)

(52) U.S. Cl. ..... 399/109; 399/252; 399/258; 430/111.4; 430/110.4

(58) Field of Classification Search ..... 430/111.4, 430/110.4; 399/109, 252, 258
See application file for complete search history.

(56) References Cited

U.S. PATENT DOCUMENTS

| | | | |
|---|---|---|---|
| 5,112,714 | A | 5/1992 | Imai et al. |
| 6,278,853 | B1 | 8/2001 | Ban et al. |
| 6,667,141 | B2 | 12/2003 | Iwamoto et al. |
| 6,790,575 | B2 | 9/2004 | Sasaki et al. |
| 6,828,075 | B2 | 12/2004 | Suzuki et al. |
| 6,835,517 | B2 | 12/2004 | Kondo et al. |
| 6,856,781 | B2 | 2/2005 | Matsuda et al. |
| 6,887,636 | B2 | 5/2005 | Matsuda et al. |
| 6,899,986 | B2 | 5/2005 | Aoki et al. |
| 6,934,484 | B2 | 8/2005 | Suzuki et al. |
| 7,177,555 | B2 * | 2/2007 | Shu et al. ..... 399/27 |
| 2003/0104297 | A1 | 6/2003 | Matsuda et al. |
| 2003/0134220 | A1 | 7/2003 | Emoto et al. |
| 2003/0152857 | A1 | 8/2003 | Sugiura et al. |

(Continued)

FOREIGN PATENT DOCUMENTS

| | | | |
|---|---|---|---|
| CN | 1405637 | A | 3/2003 |

(Continued)

OTHER PUBLICATIONS

U.S. Appl. No. 11/931,590, filing date Oct. 31, 2007, Hasegawa et al.

(Continued)

*Primary Examiner*—Mark A Chapman
(74) *Attorney, Agent, or Firm*—Oblon, Spivak, McClelland, Maier & Neustadt, P.C.

(57) ABSTRACT

The object is to provide a toner which can be smoothly replenished by a toner replenishing device using a powder pump even when the toner contains a releasing agent, and an image forming apparatus using the toner. There is provided a toner, which comprises a binder resin, a colorant and a releasing agent, has a dynamic friction coefficient of 0.15 to 0.35, and is replenished by the toner replenishing device having a powder pump configured to automatically supply the toner and a toner container arranged in conjunction with the powder pump so as to develop a latent electrostatic image on a image bearing member.

17 Claims, 4 Drawing Sheets

U.S. PATENT DOCUMENTS

| | | | |
|---|---|---|---|
| 2003/0232266 | A1 | 12/2003 | Sugiura et al. |
| 2004/0146309 | A1 | 7/2004 | Shu et al. |
| 2004/0157147 | A1 | 8/2004 | Shiraishi et al. |
| 2004/0234879 | A1 | 11/2004 | Hasegawa et al. |
| 2005/0026064 | A1 | 2/2005 | Sugiura et al. |
| 2005/0064310 | A1 | 3/2005 | Masuda et al. |
| 2005/0079430 | A1 | 4/2005 | Aoki et al. |
| 2005/0089786 | A1 | 4/2005 | Sugiura et al. |
| 2005/0089787 | A1 | 4/2005 | Uchinokura et al. |

FOREIGN PATENT DOCUMENTS

| | | | |
|---|---|---|---|
| EP | 1 193 570 | A2 | 4/2002 |
| JP | 4-143781 | | 5/1992 |
| JP | 9-244294 | | 9/1997 |
| JP | 2001-5220 | | 1/2001 |
| JP | 2002-6549 | | 1/2002 |
| JP | 2002-87592 | | 3/2002 |
| JP | 2002-91143 | | 3/2002 |
| JP | 2002-278161 | | 9/2002 |
| JP | 2002-351126 | | 12/2002 |
| JP | 2003-107777 | | 4/2003 |
| JP | 2004-37911 | | 2/2004 |
| JP | 2004-240100 | | 8/2004 |

OTHER PUBLICATIONS

U.S. Appl. No. 11/956,378, filed Dec. 14, 2007, Shu et al.
U.S. Appl. No. 11/950,114, filed Dec. 4, 2007, Shitara et al.
U.S. Appl. No. 11/408,031, filed Apr. 21, 2006, Shu et al.
U.S. Appl. No. 12/042,538, filed Mar. 5, 2008, Hasegawa.
U.S. Appl. No. 10/784,204, filed Feb. 24, 2004, Umemura et al.

* cited by examiner

TONER, IMAGE FORMING APPARATUS USING THE SAME AND PROCESS CARTRIDGE

BACKGROUND OF THE INVENTION

1. Field of the Invention

The present invention relates to a toner used in image formation by an electrostatic process, such as a copying machine, a facsimile machine and a printer, and an image forming apparatus and a process cartridge using the toner.

2. Description of the Related Art

In an image forming apparatus utilizing an electrophotographic system, a toner image is formed on a photoconductor through charging the surface of an image bearing member (hereinafter referred to as a "photoconductor" or "electrophotographic conductor") with a discharged electrical change, exposing the surface of the charged photoconductor to form a latent electrostatic image, and developing the latent electrostatic image formed on the surface of the photoconductor by supplying a toner. The developing is carried out using a developing unit arranged in the image forming apparatus, and the toner contained in a toner container is replenished to the developing unit to compensate for toner consumption.

Recently, high and accurate reproducibility of image to be formed has come to be demanded. For this reason, toner with small particle size is used to meet this demand. However, toner with a small particle size has the problem that the powder mobility of the toner is reduced, causing incomplete replenishment by creating a snow-cave like pocket when a screw is used to supply the toner. In addition, toner particles are attached to the screw and the like to cause clogging by the toner.

Instead of monochromic images, full-color images are in greater demand in the market. To produce glossy full-color images with good quality, chromatic colorant needs to be finely dispersed within the toner to reduce the softening point of a binder resin. However, low-molecular-mass or crystallized organic pigment or dye is used as the chromatic colorant, causing deterioration of the cohesive properties of the toner so as to be more difficult of quantitative replenishment of the toner.

Recently, image forming apparatuses have tended to become smaller and its processing speed has tended to become faster. Such a high speed image forming apparatus requires a large amount of toner to be replenished, resulting in the larger size of a toner container. Further, a reliable replenishing performance is required. Coincidentally, for the reduction of the size of the overall image forming apparatus, downsizing of a fixing unit is given. For example, silicone oil or the like has been used to improve the releasing properties of the fixing unit, but the removal of a silicone oil tank has been required as the tank prevents the reduction of size. Instead of providing the releasing properties to the fixing unit, an approach to mix a releasing agent such as wax in a toner to provide the releasing properties to the toner has been used to enable a reduction in the size of the apparatus. Additionally, the toner container may be arranged away from the developing unit to reduce the size of the image forming apparatus. For this reason, a toner replenishing system utilizing a powder pump has been used to efficiently and stably replenish the toner from a separate toner container installed in the development means.

For example, Japanese Patent Application Laid-Open (JP-A) No. 2004-037911 discloses an image forming apparatus wherein an air supply path from an air outlet of an air pump to an air connection hole being a confluence part between a path and a toner sending tube in a toner supply path is arranged above the bottom position of the path and the toner sending tube in the graviatation direction.

Furthermore, JP-A No. 2002-087592 discloses a powder transfer pump, which comprises a stator with a through hole and a rotor arranged in the through hole, wherein the powder is transferred from an inlet side of the through hole to an outlet side of the through hole by means of the rotor rotation, and an agitator is provided so that the powder discharged from the outlet of the through hole is agitated by the agitator.

However, even with the use of powder transfer pumps disclosed in the above-mentioned applications, it is difficult in the toner supply system utilizing a powder pump to achieve smooth toner replenishment with a toner utilizing a soft binder resin and containing low-molecular-mass or crystallized organic pigment or dye as chromatic colorant as well as a releasing agent. In addition, even if it is possible, there are still image failure problems such as occurrences of white dots and deteriorated image density as the toner must go through under various stresses in the toner replenishment path.

SUMMARY OF THE INVENTION

An object of the present invention is to provide a toner which can be smoothly replenished by a toner replenishing device using a powder pump without causing image failures such as the appearances of white dots and image density deterioration even when the toner utilizes a soft binder resin and contains low-molecular-mass organic pigment or dye as a chromatic colorant as well as a releasing agent, and an image forming apparatus and a process cartridge using the toner.

The present invention provides a toner, which comprises a binder resin, a colorant and a releasing agent, wherein the toner has a dynamic friction coefficient of 0.15 to 0.35 and is replenished by a toner replenishing device comprising a pump configured to supply the toner and a toner container arranged in conjunction with the pump.

Preferably, the colorant is a chromatic colorant, and the toner replenishment system has an air supply means to mobilize a toner stored in a toner container.

Preferably, the toner replenishing device further comprises an air supply unit configured to fluidize the toner contained in the toner container.

Preferably, the toner container comprises a toner outlet and a flexible main body of which volume reduction rate is 60% or more.

Preferably, the toner container is configured to be mounted to a main body of an image forming apparatus, the toner replenishing device is configured so that a driven part of the pump side is brought into driving engagement with a drive part of the image forming apparatus side when the toner container is mounted to the main body of the image forming apparatus, and the toner makes contact with a part of the driven part by the driving engagement.

Preferably, the relseasing agent in the toner has a dispersion diameter of 0.03 μm to 2.0 μm.

Preferably, the toner has a volume-average particle diameter of 3 μm to 8 μm and the content of toner particles having a particle diameter of 0.7 μm to 2.0 μm is 10% by number or less when measured by a flow-type particle image analyzer.

Preferably, the toner comprises fine particles having a volume-average diameter of primary particles of 30 nm to 300 nm on the surface thereof.

Preferably, the fine particles are at least one of organic fine particles and inorganic fine particles.

Preferably, the toner is obtained by: dissolving or dispersing toner materials containing at least active hydrogen group-containing compound and polymer reactive with the active hydrogen group-containing compound in an organic solvent to prepare a toner solution; emulsifying and dispersing the toner solution in an aqueous medium to prepare a dispersion thereof; reacting the active hydrogen group-containing compound and the polymer reactive to the active hydrogen group-containing compound in the aqueous medium to granulate adhesive base materials; and removing the organic solvent.

Preferably, the toner container comprises a container main body formed of a flexible member of a resin film.

Preferably, the toner container comprises a toner outlet and an engaging portion at which the toner outlet and a tublar body are engaged and the engagement is maintained.

Preferably, the toner replenishing device comprises a toner transfer path which is formed between a developing unit of an image forming apparatus and the toner container and supplies the toner from the toner container to the developing unit through the toner transfer path by means of an air stream.

Preferably, the air supply unit of the toner replenishing device is a blowing air pump.

Preferably, the toner replenishing device is configured so that the pump comprises, as main members, a fixed hollow elastic member and a rigid coil-shaped axis making contact with an inner wall of the hollow elasteic member and a mixture fluid of the toner discharged from the toner container and an air is transferred by rotating the axis to prevent the mixture fluid from flowing back.

Preferably, the toner replenishing device is configured to facilitate the fluidization of the toner by giving a shake or shock to the toner container containing the toner.

The present invention provides an image forming apparatus comprising a latent electrostatic image bearing member; a charging unit configured to uniformly charge a surface of the image bearing member; an exposing unit configured to form a latent electrostatic image on the surface of the charged image bearing member; a developing unit configured to develop the latent electrostatic image formed on the surface of the image bearing member by supplying a toner to form a visible image; a transferring unit configured to transfer the visible image formed on the surface of the image bearing member to a recording medium; a fixing unit configured to fix the visible image on the recording medium by application of at least one of heat and puressure; a cleaning unit configured to clean a residual toner on the imge bearing member; and a toner replenishing device configured to replenish the toner to the developing unit, wherein the toner is replenished by the toner replenishing devide comprising a pump configured to supply the toner and a toner container arranged in conjunction with the pump, and wherein the toner comprises a binder resin, a colorant and a releasing agent and has a dynamic friction coefficient of 0.15 to 0.35.

Preferably, the image bearing member and at least one unit selected from the group consisting of the charging unit, the developing unit and the cleaning unit are formed in an integral construction as a process cartridge, the process cartridge being provided detachably in a main body of the image forming apparatus.

The present invention provides a process cartridge comprising an image bearing member; and at least one unit selected from the group consisnting of a charging unit, a developing unit and cleaning unit, wherein the process cartridge is integrated with the image bearing member and at least one unit selected from the group consisting of the charging unit, the developing unit and the cleaning unit, which is provided detachably in an image forming apparatus, a toner used in the process cartridge is replenished by the toner replenishing devide comprising a pump configured to supply the toner and a toner container arranged in conjunction with the pump, and the toner comprises a binder resin, a colorant and a releasing agent and has a dynamic friction coefficient of 0.15 to 0.35.

BREIF DESCRIPTION OF THE DRAWING

DESCRIPTION OF THE PREFERRED EMBODIMENT (Toner)

The toner according to the present invention is replenished by a toner replenishing device comprising a pump configured to supply the toner and a toner container arranged in conjunction with the pump, and the toner comprises a binder resin, a colorant and a releasing agent, and other component as needed.

Figure 1:
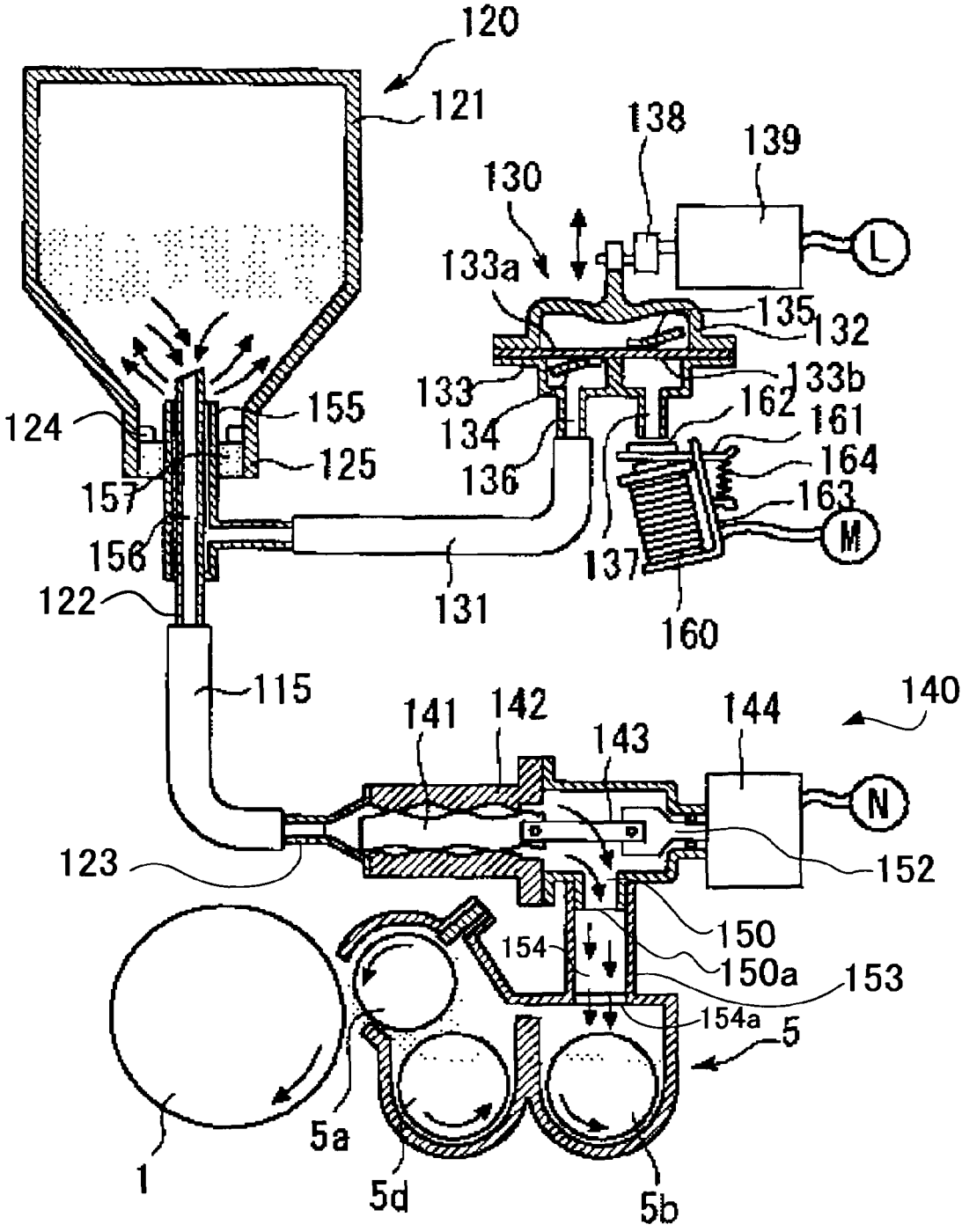
FIG. 1 is a diagram schematically showing a toner replenishing device using a toner according to the present invention.
Figure 2:
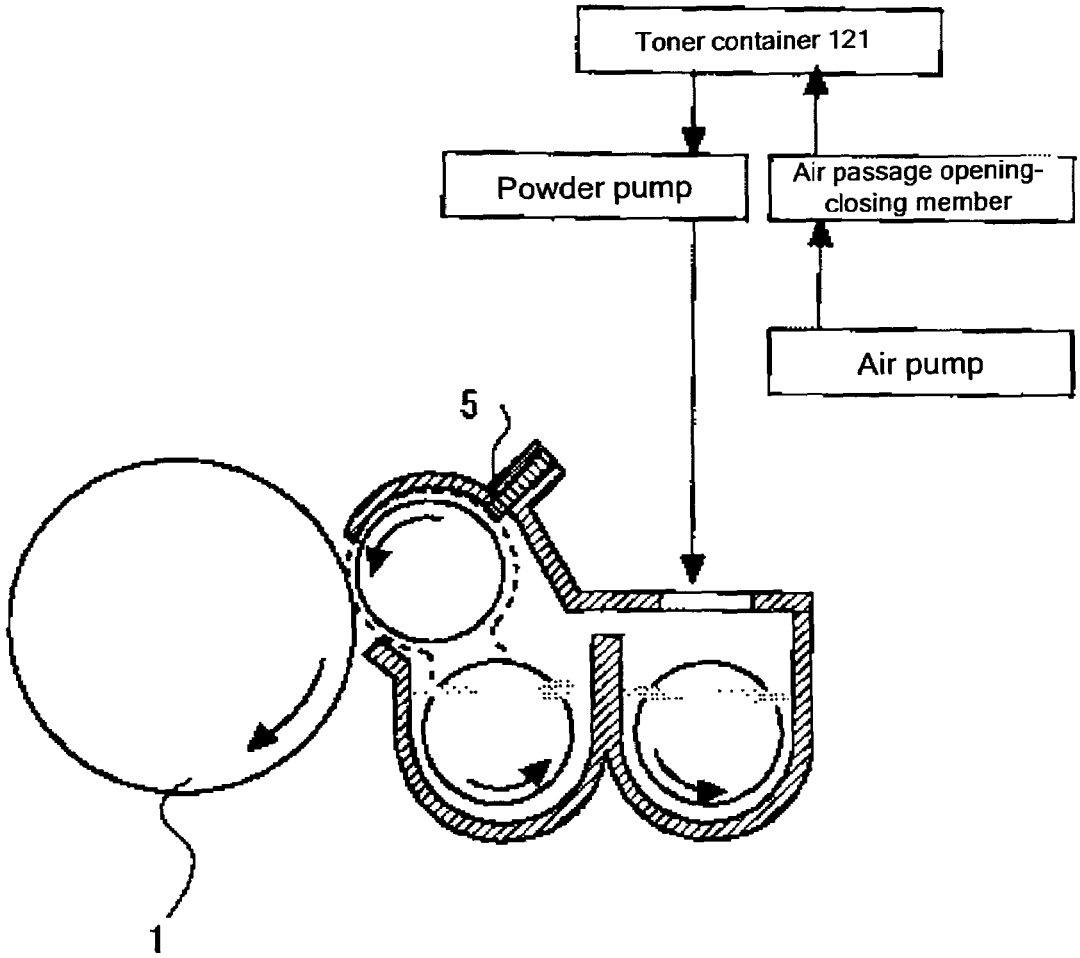
FIG. 2 is a block diagram showing the toner replenishing device in FIG. 1.

Here, FIG. 1 is a diagram schematically showing a toner replenishing device using a toner according to the present invention and FIG. 2 is a block diagram showing the toner replenishing device in FIG. 1.

In FIGS. 1 and 2, a toner replenishing device 120 is driven and controlled as follows; a powder pump 140, known as a Mohno pump is driven and controlled and an air pump 130 is operated and controlled by a power source and a control circuit, not shown in the figure. The control of the toner replenishing device 120 utilizes the mechanism for controlling the amount of toner replenishment by monitoring the changes of the toner-to-carrier mixture ratio based on a toner concentration sensor installed in a part of a developing unit 5. However, other mechanisms such as the technology controlling the amount of toner replenishment by detecting the reflection density of the toner image on a photoconductor 1 may be used. The toner replenishing device 120 is controlled by the control device equipped with an MPU, not shown in the figure. In short, toner replenishing device of the developing unit 5 is carried out by inputting the detection results by the toner concentration sensor into the MPU, transmitting an operation signal from the MPU to the powder pump driving source, a drive transmitting means, such as clutch, or the air pump 130, depending on the detection results. Since MPU has a timer, it can drive and control a driving motor and the air pump 130 at any given point in time.

The toner according to the present invention is replenished by the toner replenishing device 120, described above.

The dynamic friction coefficient of the toner can be adjusted to the range of 0.15 to 0.35 by changing the type of a binder resin contained in the toner, the particle diameter and the level of surface exposure of the releasing agent in the toner, or the type and the amount and the level of surface exposure of a chromatic colorant. For example, when adjusting the ratio of the releasing agent on the toner surface, if the releasing agent is is dispersed uniformly in a small size, the amount of the releasing agent on the toner surface is equal to the amount of the releasing agent included in the toner. However, if the releasing agent is dispersed in a large size, the amount of the releasing agent on the toner surface is larger than the amount of the releasing agent included in the toner. For crushed type toner, when mixed toner needs to be pulverized to reduce its size, in many cases the toner is pulverized by utilizing an external force such as a mechanical shock or shock by a jet stream, and pulverization starts from the most fragile part with the application of an external force. Therefore, in the case of the releasing agent, when the powder size of the releasing agent is great, the amount of the releasing agent on the surface of the toner becomes great. The dispersion state of the releasing agent largely depends on the ratio of the mixture and when the torque at the time of mixing is great, the friction coefficiency becomes great, but the size of particles in the raw material of the releasing agent used in the toner affects the toner dispersion stage.

The average particle size of raw material of the releasing agent is preferably to be between 30 μm and 120 μm, more preferably to be between 30 μm to 80 μm, and furthermore preferably between 30 μm and 50 μm. Since the dispersion of the powder in toner become favorable as the average particle size of the releasing agent in the raw material becomes smaller, the targeted friction coefficient is still obtained even if an excessive amount of the powder is fed as a prescription.

In addition, the difference between the acid value of the releasing agent and that of at least one of the resins in the toner is preferably 10 or less, or more preferably 8 or less, and even more preferably between 0 and 5. When the difference is within the acid value range, the dispersibility of the binder resin and the releasing agent is improved. In addition, when a polymerized agent is used, the stirring speed, temperature and the amount of the surfactant upon dispersion in solvent needs to be changed to adjust the ratio of the amount of the releasing agent on the toner surface. For example, when the dispersibility is adjusted with organic pigments, industrial conditions such as master batching of the pigments and resins can be used in advance to control the dispersibility. Similar to the releasing agent, when the pigments are dispersed in a large size, the amount of the pigments on the surface of the toner is increased, resulting in an increase of the dynamic friction coefficiency. Additionally, the difference in the level of crystallization of the resins and the pigments upon preparing the master batch is preferably small in order to improve dispersibility. When crystallized organic pigments are used, the dispersibility of the pigments is dramatically improved by preparing the master batch with crystallized resins, and the dynamic friction coefficient is also decreased.

Thus, the dynamic friction coefficient of the toner can be adjusted to between 0.15 and 0.35, preferably to between 0.20 and 0.30, and more preferably to between 0.20 and 0.25 with appropriate selection of raw materials and toner manufacturing methods.

When the dynamic friction coefficient of the toner is less than 0.15, it is difficult to replenish the toner with a powder pump to cause clogging by the aggregation of the toner, and more specifically replenishment troubles such as deteriorated mobility by wax paint when preserved, as well as causing problems in image quality, such as the occurrence of white dots caused by aggregation and degraded image density by deteriorated developing ability resulting from poor dispersion of wax. In contrast, when the dynamic friction coefficient exceeds 0.35, there is the replenishment problem of making it difficult to replenish the toner with a powder pump due to the tightly packed toner causing an unstable supply of the powder or the durability of the supply pump is decreased as high friction leads to supply pump wear. Finally, high friction causes problems such as streak images caused from scratching the OPC surface, lowered image density by deteriorated developing ability caused by poor dispersion of pigments, and non-uniformity in gloss.

Here, the dynamic friction coefficient of the toner is measured using an automatic friction and abrasion analyzer manufactured by Kyowa Interface Science Co., Ltd. by using a disc-shaped pellet with a diameter of 40 mm after applying a load of 6 t/cm$^2$ to 3 g of a toner sample. At this time, a point contact member, namely a stainless steel ball 3 mm in diameter is used as a contact member.

In the toner replenishing device 120, when a toner replenishing signal is transmitted, the rotor 141 and the air pump 130 of the powder pump 140 simultaneously operate for a predetermined time to send a mobilized toner to the developing unit 5 via a transfer tube 115 by the powder pump 140. The air pump 130 ceases operation after a predetermined time when the rotor 141 of the powder pump 140 stops operation. In this way, toner clog in the toner transfer tube 115 is prevented as a residual toner in the transfer tube 115 is removed only by air.

It is highly effective to use highly flexible tube-shaped rubber, such as polyurethane rubber, nitrile rubber, EPDM and silicone rubber with an inner diameter of 4 mm to 10 mm, as the transfer tube 115. However, toner may clog in the transfer tube 115 when the mobility of the toner is low. Therefore, the dynamic friction coefficient of the toner should be adjusted to within a range of 0.15 to 0.35 when an external additive is absent. Although the addition of the external additive increases the mobility of the toner, the stability during the transfer in the tube will be increased by setting the dynamic friction coefficient of the toner to be 0.15 to 0.35. When the dynamic friction coefficient of the toner is large, a dead portion of the toner is created at the bent part even when the transfer tube 115 with small friction coefficiency is used or the toner is clogged in the transfer tube 115 to decrease toner transfer stability. When the dynamic friction coefficient of the toner is low, it prevents stably supplying a certain amount of toner to the developing unit 5 as it causes poor transfer in the powder pump 140 and the air pump 130.

In addition, it is preferable to use a releasing agent in the toner with a dispersion diameter in the range of 0.03 μm to 2.0 μm. When the dispersion diameter of the releasing agent is small, the ratio of the releasing agent exposed to the toner surface is decreased although the amount of the releasing agent dispersed in the toner is increased. In contrast, when the dispersion diameter of the releasing agent is large, the ratio o the releasing agent exposed to the toner surface is increased although the amount of the releasing agent dispersed in the toner is decreased. By adjusting the dispersion diameter of the releasing agent to 0.03 μm to 2.0 μm, the dynamic friction coefficient of the toner falls to within the range of 0.15 to 0.35.

In addition, a bag-type toner container 121 of the toner replenishing device 120 has an opening in the middle of the bottom in which a metal cap member 122 made from resin such as polyethylene and nylon is fixed. The toner container 121 is a flexible and deformable bag and its bag member 121 is preferably a bag-shaped container made from a single layer or multiple layers of a flexible sheet material of a polyester film or polyethylene film (approximately 80 μm to 125 μm in thickness). In addition, it is preferable that the volume of the toner container main body 121 be reduced by more than 60%. As the toner is aspirated, the volume within the toner container 121 is reduced. In this case, by the air introduction, the occurrence of the toner clog caused by local deformation of the bag-shaped toner container 121 during the volume reduction is suppressed, and simultaneously, the sucking efficiency of the powder pump 140 is increased by facilitating the removal of the toner from the container without there being residual toner in the bag. In addition, the shape of the toner container 121 is not limited to this bag, but can be a horizontal type as long as the toner is transferred to the powder pump 140.

Additionally, in order to stably aspirate and transfer toner having extremely poor mobility, it is effective to adequately shake or shock the toner container 121 in addition to the air introduction to the inside of the toner container 121, which also prevents the bridge phenomenon so as to stably transfer toner to the toner transfer tube 115. More specifically, an intermittent shock by a conventionally known cam and a lever may be added or a vibration by a motor or solenoid may be added. A toner transfer path is formed by connecting the toner container 121 and the developing unit 5 with a long toner transfer tube 115. More specifically, the toner transfer path is formed between the connection part of one end of the toner transfer tube 115 and the opening of the toner container and the connection part of the other end of the toner transfer tube 115 and the developing unit 5.

The toner transfer path at least consists of the air pump 130 which creates an air flow and the narrow and long toner transfer tube 115. The narrow and long toner transfer tube 115 is arranged between the toner container 121 and the developing unit 5 and is connected thereto, therefore the toner transfer tube 115 have a role in discharging the toner from the toner container 121 and supplying it to the developing unit 5

In addition, the metal cap 122 of the toner container 121 is sleeve-shaped. The powder pump 140 is detachably mounted in a hollow of the metal cap. The powder pump 140 is a discharge type single-axle decentralized screw pump comprising a decentralized screw-shaped rotor 141 made of rigid material such as metal and a two streak screw-shaped stator 142 made of an elastic material such as rubber, which is fixed and arranged to the powder pump 140. In this case, the stator 142 is engaged to the metal cap 122 from below, the stator is maintained at the engaged position by a holding member 123. The holding member 123 is detachably fixed by screwing to or engaging with the metal cap 122, the stator 142 and the rotor 141 is removable by detaching the holding member 123 from the toner container 121, as shown in FIG. 1.

The metal cap 122 is provided with a stopper 124 via an arm or the like, preventing the rotor 141 from rotating and entering the container 121. Additionally, the stopper 124 may be provided with a roller bearing to rotatingly hold the rotor 141. A setting part 150 at which the toner container 121 is set is arranged in the main body of the image forming apparatus. The setting part 150 is provided with a vertically expandable drive shaft (not shown), which is rotatingly driven by a driving source (not shown) of the main body of the image forming apparatus side. The drive shaft is rotatably held by a lower member 150*a* of the setting part 150 via a roller bearing 153. A joint 152, which is engageable to the rotor 141, is fixed to the tip portion, namely the upper end portion of the drive shaft. In addition, the drive shaft is attached to be vertically movable and is biased upward with a spring 154. Therefore, the drive shaft waits in the standby mode in a position where a clamping plate 154*a* contacts the roller bearing 153, and once the toner container 121 is set, the joint 152 is engaged in the rotor 141 in a position lower than the standby position, resisting the action of the spring 154 to ensure that it is engaged firmly by the spring action.

An outlet portion where a toner is discharged by the powder pump 140 is formed in the setting part 150 to have a shaped like a horizontally expandable pipe. One end of the outlet portion is connected to the developing unit 5 via the transfer tube 115 and the other end is connected to the air pump 130 as an air supply unit via an air pipe 131. Therefore, toner discharged from the container by the powder pump 140 is transferred to the developing unit 5 by air flow.

The single-axle decentralized screw pump, namely a powder pump 140 is known to be capable of continuously transferring powder in a high weight mixture ratio to provide an accurate amount of transferred toner proportional to the rotation speed of the rotor 141. Therefore, the control of the toner transfer, namely the toner replenishment, is carried out by adjusting the rotating speed of the powder pump 140 and the related driving time. The powder pump 140 generates discharge pressure downward and suction pressure upward when the rotor 141 rotates. The power of the discharge pressure and the suction pressure depend on the shapes of the rotor 141 of the powder pump 140 and the stator 142 or the rotation speed of the rotor 141. However, when the dynamic friction coefficient of the toner is less than 0.15, a dead portion of the toner is created in the powder pump 140 causing clogging. In addition, toner may form aggregation when a soft releasing agent is used. In contrast, when the dynamic friction coefficient is greater than 0.35, the amount of transfer fluctuates, resulting in unstable toner concentration in the developing unit 5.

The powder pump 140 provided in the toner container 121 serves as a self-closing valve to completely seal when idling, namely it seals the opening of the toner container 121 to prevent toner from scattering outside even if the particle size of the toner is small. Therefore, toner scatter and contamination upon toner exchange is completely prevented. Furthermore, since the powder pump 140 is detachable from the toner container 121, the pump part is recycled and reused. Furthermore, the powder pump 140 life ends when the stator 142, made of rubber, is worn out. In this case, the rotor 141 can be used many times as long as the stator 142 is replaced. The lower part of the toner container 121 is shaped as a funnel towards a toner discharge hole, and therefore, the toner in the container 121 is discharged without dislodging in the container by gravity as well as by the suction power upstream of the power pump 140.

In this way, the toner replenishing device 120 can stably supply toner to the developing unit 5 without forming aggregation by the powder pump 140, known as a Mohno pump, the air pump 130 and the toner container 121 even when using toner containing a releasing agent, with poor mobility and having a tendency to form aggregation.

In addition, it is preferable that the volume-average particle diameter of a toner be in the range of 3 μm to 8 μm. In this range, it provides excellent dot reproducibility since toner particles are small in comparison with a fine latent image dot. When the volume-average particle diameter is less than 3 μm, there is the problem of lower productivity and lower cleaning ability by a blade. Conversely, when it exceeds 8 μm, it may be difficult to suppress spattering text and lines.

In order to measure the volume-average particle diameter of the toner, for example, a coulter counter TA-II and coulter multisizer II (both from Coulter Inc.) can be used as the measuring device for the average particle distribution of toner particles using the Coulter counter method.

It is preferable that the content of toner particles having particle diameter of 0.7 μm to 2.0 μm is 10% by number or less when measured by a flow-type particle image analyzer. In the case where the developer or toner make contact with a driven member, such as the drive shaft, there is a possibility that fine particles in the toner enter a driven part. More specifically, in the case of employing a system such that a drive part (the driving source of the image forming apparatus side, not shown) is driven when the toner container is mounted in the main body of the image forming apparatus as in the powder pump 140, the toner transfer is seriously affected by the reliability of the drive part. When the reliability of the drive part decreases, it results in toner clogging, a sticky toner and noise.

To ensure a reliable drive portion, it is preferable that the content of toner particles having particle diameter of 0.7 μm and 2.0 μm is 10% by number or less, more preferably 5% by number or less, and further preferably 3% by number or less when measured by the flow-type particle image analyzer.

Additionally, the toner has fine particles having a volume-average diameter of primary particles of 30 nm to 300 nm on the surface of the toner. For the fine particles, at least one of inorganic fine particles and organic fine particles is used. When the volume-average diameter of primary particles is less than 30 nm, it is subject to heat or mechanical shock to adhere to the drive connection part of the powder pump 140. In contrast, if the volume-average diameter of primary particles is greater than 300 nm, the fixing property decreases since the contact between the toner surface and other members are prevented, and the toner mobility decreases, making it difficult to transfer the toner with the powder pump 140 in the toner replenishing device 120. Therefore, it is preferable to use fine particles as an external additive having a volume-average diameter of primary particles of between 30 nm and 300 nm, or more preferably between 80 nm and 200 nm.

Examples of the inorganic particles include silicas, aluminas, titanium oxides, barium titanates, magnesium titanates, calcium titanates, strontium titanates, zinc oxides, tin oxides, silica sand, clay, mica, wallastonite, silious earth, chromium oxides, ceric oxides, colcothar, antimony trioxides, magnesium oxides, zirconium oxides, barium sulfates, barium carbonates, calcium carbonates, silicon carbides, and silicon nitrides.

The amount of the inorganic fine particles to be added to the toner is preferably 0.1% by mass to 10% by mass, more preferably 1.0% by mass to 5.0% by mass.

Examples of the organic particles include polymer particles such as polystyrene copolymers, methacrylic acid ester copolymers, and acrylic acid ester copolymers obtained by soap-free emulsion polymerization, suspension polymerization, and dispersion polymerization; and condensation polymers such as silicone, benzoguanamine, and nylon, and thermosetting resins.

These external additives enable preventing deteriorations of fluidity and charge properties of the toner even under high-humidity environment by performing surface treatment thereof to improve hydrophobic properties. Examples of preferable surface treatment agents include silane coupling agents, sililation reagents, silane coupling agents having a fluorinated alkyl group, organic titanate coupling agents, aluminum coupling agents, silicone oils, and modified silicone oils. Particularly, it is preferable to use hydrophobic silica and hydrophobic titanium oxide obtained from silica and titanium oxide, respectively by the above-mentioned surface treatment.

The toner specifications will be described below. The toner is made from at least a binder resin, chromatic colorant and releasing agent and may be manufactured by a pulverizing or polymerizing method such as suspension polymerization, emulsion polymerization, dispersion polymerization, emulsion aggregation and emulsion association, but it is not limited to these methods.

It is also preferable to use an almost globular-shaped toner with a small particle diameter to output an image with high quality and accuracy. Such a toner manufacturing method includes the suspension polymerization method, emulsion polymerization method and polymer suspension method in which an oily phase is emulsified, suspended or aggregated in an aqueous medium to form toner base particles. These toner manufacturing methods, materials and additives used in these manufacturing methods will be described hereafter.

—Suspension Polymerization Method—

In the suspension polymerization method, colorants and a releasing agent are dispersed in an oily soluble polymerization initiator and polymerizing monomers and emulsified and dispersed in an aqueous medium containing a surfactant and other solid dispersants by the emulsion method. At this time, the particle size of the releasing agent is adjusted by the stirring speed and temperature in dispersing the releasing agent. Then, after being pulverized by the polymerization reaction, a wetting treatment according to the present invention, described later, to attach inorganic fine particles on the surface of the toner particles is performed. At this time, it is preferable to wash off excess surfactant from the toner particles prior to the treatment.

Examples of the polymeric monomer include acids such as acrylic acid, methacrylic acid, α-cyanoacrylic acid, α-cyanomethacrylic acid, itaconic acid, crotonic acid, fumaric acid, maleic acid, and maleic anhydride; acrylamide, methacrylamide, diacetone acrylamide, and methylol compounds thereof; vinylpyridine, vinylpyrrolidone, vinylimidazole, and ethyleneimine, acrylates having an amino group such as 2-(dimethylamino)ethyl methacrylate and methacrylate. By using the dispersant having an acid group or basic group, the dispersants can be absorbed to and remain on the surface of the toner particles, thereby the functional group is introduced to the surface of the toner particles.

—Emulsion Polymerization Aggregation Method—

In the emulsion polymerization aggregation method, a water soluble polymerization initiator and a polymerizing monomer are emulsified using a surfactant in water to synthesize latex using a regular emulsion polymerization method. A toner was obtained by preparing the dispersions of a colorant and a releasing agent with a certain size of particle diameter dispersed in aqueous medium separately, mixing to form aggregate to the appropriate toner size and heat-sealing them together. Then, the wetting treatment of the inorganic fine particle is performed. Latex similar to the polymers used in the suspension polymerization method can be used to introduce the functioning group to the surface of the toner particles.

—Polymer Suspension Method—

In the polymer suspension method, an oily phase made of toner materials is dispersed in an aqueous medium under the presence of a surfactant and a solid dispersant and pre-polymer reaction is performed to form particles. Then, the wetting treatment of the inorganic fine particles, described later, is performed.

For the aqueous medium, water can be used alone, or alternatively a solvent mixable with water can be used in combination. Such solvents mixable with water include alcohol such as methanol, isopropanol and ethylene glycol, dimethylformaldehyde and tetrahydrofuran, cellosolves such as methylcellosolve, and lower ketones such as acetone and methylethylketone. For the oily phase of the toner composition, resins, pre-polymers and pigment colorant, a releasing agent with a controlled particle size, and a charging control agent are dissolved or dispersed in a volatile solvent.

—Dry Pulverizing Method—

As an example of producing a pulverized toner, it is possible to use a toner production method which comprises mechanically mixing raw materials including at least a binder resin, a charge controlling agent, and a colorant; dissolving and kneading the materials; pulverizing the materials; and classifying toner particles. To improve dispersibility of a colorant, the colorant may be mixed with other raw materials after preparation of masterbatch and then mixed in the next step.

In the mechanically mixing, materials may be mechanically mixed under normal conditions using a typical mixer with rotational blades, and the mixing method is not particularly limited. Upon completion of the mixing, the mixtures are poured into a kneader to dissolve and knead them. For the kneader for dissolving the mixtures, single-screw or double-screw continuous kneaders and batch kneaders using roll mill can be used. For a specific unit for kneading the toner, preferred examples thereof include batch double rolls; banbary mixers; continuous double-screw extruders, for example, KTK type double-screw extruder manufactured by KOBE STEEL, LTD.; TEM type double-screw extruder manufactured by TOSHIBA MACHINE CO., LTD.; double-screw extruder manufactured by KCK Co., Ltd.; PCM type double-screw extruder manufactured by Ikegai Corp.; KEX type double-screw extruder manufactured by KURIMOTO, LTD.; and continuous type single-screw kneaders, for example, Co-kneader manufactured by Buss. The obtained molten kneaded mixture was cooled and then crushed. For example, the mixture was coarsely crushed using a hammer mill and Rotoplex Granulator Cutting Mill, and further a pulverizing mill using jet stream and a mechanical pulverizer can be used. Preferably, the mixture is pulverized so that the toner particles have an average particle diameter of 3 μm to 15 μm. Further, the particle size of the pulverized mixture is controlled to be 2.5 μm to 20 μm through the use of a wind-driven classifier or the like. Next, external additives are added to the toner particles. By mixing and agitating the toner particles and external additives using a mixer or the like, the external additives are coated on surfaces of the toner particles while being milled.

For the pulverized toner, although commonly known binder resins may be used, it is preferable to use polyester resin with the object of increasing pigment dispersion and to obtain the image in a wide range of color reproducibility.

Further, a polyester resin serving as a binder resin which comprises a linear polyester without including components insoluble in tetrahydrofuran or THF and a nonlinear polyester including components insoluble in tetrahydrofuran or THF allows ensuring a much wider fixing temperature range. By adding a linear polyester and a nonlinear polyester, low-temperature fixing property can be improved by the linear polyester, and anti-hot-offset property can be improved by the nonlinear polyester, however, in order not to impair glossiness of toner, dispersibility of releasing agent must be improved. To improve dispersibility of releasing agent, typically, it can be improved by controlling shearing force and dispersibility mechanically when kneading toner materials, however, in actuality, it is difficult to separate shearing force and dispersibility completely to control them. When dispersibility is improved, shearing force is also improved in synchronization with the improved dispersibility. This moves ahead with low-molecular-mass of toner particles to make it impossible to improve anti-hot offset property through the use of a nonlinear polyester. However, there is not much necessity to control mechanical energy to dispersibility, and a releasing agent may be controlled by only shearing force because dispersibility of releasing agents and colorants are improved by adding the hybrid resin. By adding a hybrid resin, it is possible to improve low-temperature fixing property with a linear polyester as well as to improve anti-hot offset property with a nonlinear polyester.

Hereinafter, constituent materials of the toner will be described.

—Polyester Resin—

The polyester resin can be produced by polycondensation reaction between a polyvalent alcohol compound and a polyvalent carboxylic acid compound.

Examples of the polyvalent alcohol compound (PO) include a divalent alcohol (DIO) and a trivalent or more polyvalent alcohol (TO), and any of a divalent alcohol (DIO) alone and a mixture of a divalent alcohol (DIO) with a small amount of a polyvalent alcohol (TO) are preferable. Examples of the divalent alcohol (DIO) include alkylene glycols such as ethylene glycol, 1,2-propylene glycol, 1,3-propylene glycol, 1, 4-bytandiol, and 1,6-hexanediol; alkylene ether glycols such as diethylene glycol, triethylene glycol, dipropylene glycol, polyethylene glycol, polypropylene glycol, and polytetramethylene ether glycol; alicyclic diols such as 1,4-cyclohexane dimethanol, and hydrogenated bisphenol A; bisphenols such as bispheonol A, bisphenol F, and bisphenol S; alkylene oxide adducts of the above-noted alicyclic diols such as ethylene oxides, propylene oxides, and butylene oxides; and alkylene oxide adducts of the above-noted bisphenols such as an ethylene oxide, propylene oxides, and butylene oxides. Among the above mentioned, an alkylene glycol having carbon atoms 2 to 12 and an alkylene oxide adduct of bisphenols are preferable, and an alkylene oxide adduct of bisphenols and a combination of the adduct with an alkylene glycol having carbon atoms 2 to 12 are particularly preferable. Examples of the trivalent or more polyvalent alcohol (TO) include polyaliphatic alcohols of trivalent to octavalent or more such as glycerine, trimethylol ethane, trimethylol propane, pentaerythritol, and sorbitol; and trivalent or more phenols such as trisphenol PA, phenol novolac, and cresol novolac; and alkylene oxide adducts of the trivalent or more polyphenols.

Examples of the polyvalent carboxylic acid (PC) include a divalent carboxylic acid, i.e. DIC and a trivalent or more polyvalent carboxylic acid, i.e. TC, and any of a divalent carboxylic acid (DIC) alone and a mixture of a divalent carboxylic acid (DIC) with a small amount of a polyvalent carboxylic acid (TC) are preferable. Examples of the divalent carboxylic acid (DIC) include alkylene dicarboxylic acids such as succinic acids, adipic acids, and sebacic acids; alkenylen dicarboxylic acids such as maleic acids, and fumaric acids; aromatic dicarboxylic acids such as phthalic acids, isophthalic acids, terephthalic acids, and naphthalene dicarboxylic acids. Among these divalent carboxylic acids, an alkenylen dicarboxylic acid having carbon atoms 4 to 20 and an aromatic dicarboxylic acid having carbon atoms 8 to 20 are preferable. Examples of the trivalent or more polyvalent carboxylic acids (TC) include aromatic polyvalent carboxylic acid having carbon atoms 9 to 20 such as trimellitic acids, and pyromellitic acids. It is noted that as a polyvalent carboxylic acid (PC), an acid anhydride from among the polyvalent carboxylic acids or a lower alkyl esters such as methyl esters, ethyl esters, and isopropyl esters may be used to react to a polyvalent alcohol (PO).

A ratio of a polyvalent alcohol (PO) to a polyvalent carboxylic acid (PC), defined as an equivalent ratio [OH]/[COOH] of a hydroxyl group [OH] to a carboxyl group [COOH], is typically 2/1 to 1/1, preferably 1.5/1 to 1/1, and more preferably 1.3/1 to 1.02/1.

—Modified Polyester—

The toner of the present invention may comprise a modified polyester (i) as a binder resin. A modified polyester (i) indicates a state of a polyester in which a combined group other than ester bond may reside in a polyester resin, and different resin components are combined into a polyester resin through covalent bond, ionic bond or the like. Specifically, examples of the modified polyester include the one that functional groups such as isocyanate groups which react to carboxylic acid groups and hydrogen groups are introduced to a polyester end and further reacted to an active hydrogen-containing compound to modify the polyester end.

The modified polyester (1) includes a urea-modified polyester which is obtained by a reaction between a polyester prepolymer (A) having isocyanate groups and amines (B). Examples of the polyester prepolymer (A) having isocyanate groups include polyester prepolymers which are polycondensation polyesters of polyvalent alcohols (PO) and polyvalent carboxylic acids (PC) and produced by which polyesters having active hydrogen groups are further reacted to a polyvalent isocyanate compound. Examples of the active hydrogen groups obtained by the polyesters are hydroxyl groups such as alcoholic hydroxyl groups and phenolic hydroxyl groups, amino groups, carboxyl groups, and mercapto groups. Among these groups, alcoholic hydroxyl groups are preferable.

Examples of the polyvalent isocyanate compound (PIC) used for producing the urea-modified polyester include aliphatic polyvalent isocyanates such as tetramethylen diisocyanate, hexamethylen diisocyanate, and 2,6-diisocyanate methyl caproate; alicyclic polyisocyanates such as isophorone diisocyanate, and cyclohexyl methane diisocyanate; aromatic diisocyanate such as tolylene diisocyanate, and diphenylmethane diisocyanate; aromatic aliphatic diisocyanates such as α, α, α', α'-tetramethyl xylylene diisocyanate; isocyanates; compounds in which the above noted polyisocyanate is blocked with a phenol derivative, oximes, caprolactams; and combinations of two or more elements thereof.

The ratio of a polyvalent isocyanate compound (PIC), defined as an equivalent ratio [NCO]/[OH] of an isocyanate group [NCO] to a hydroxyl group [OH] of a polyester having a hydroxyl group, is typically 5/1 to 1/1, preferably 4/1 to 1.2/1, and more preferably 2.5/1 to 1.5/1. When the ratio [NCO]/[OH] is more than 5, low-temperature fixing properties degrade. When the molar ratio of [NCO] is less than 1 and a urea modified polyester is used, the urea content of ester lowers, resulting in degraded anti-hot-offset property.

The constituent content of polyvalent isocyanate compound (PIC) of a polyester prepolymer having an isocyanate group (A) is typically 0.5% by mass to 40% by mass, preferably 1% by mass to 30% by mass, and more preferably 2% by mass to 20% by mass. When the constituent content thereof is less than 0.5% by mass, anti-hot-offset property degrades and it may bring about disadvantages in balancing heat resistant storage properties with low-temperature fixing properties. On the other hand, when the constituent content thereof is more than 40% by mass, low-temperature fixing properties may degrade.

The number of isocyanate groups contained in per one molecular of polyester prepolymer having isocyanate group (A) is typically 1 or more, preferably 1.5 to 3 on an average, and more preferably 1.8 to 2.5 on an average. When the number of isocyanate groups is less than 1 per 1 molecular of polyester prepolymer, the molecular mass of the urea modified polyester lowers, resulting in degraded anti-hot-offset property.

Next, examples of amines (B) to be reacted to a polyester prepolymer (A) include divalent amine compounds (B1), trivalent or more polyvalent amine compounds (B2), aminoalcohols (B3), amino mercaptans (B4), amino acids (B5), and compounds in which an amino group of B1 to B5 is blocked (B6).

Examples of the divalent amine compounds (B1) include aromatic diamines such as phenylene diamines, diethyl toluene diamines, 4,4'-diamino diphenyl methanes; alicyclic diamines such as 4,4'-diamino-3,3'-dimethyl dicyclohexyl methane, diamine cyclohexane, and isophorone diamine; and aliphatic diamines such as ethylene diamine, tetramethylene diamine, and hexamethylene diamine. Examples of the trivalent or more polyvalent amine compounds (B2) include diethylene triamine, and triethylene tetramine. Examples of the aminoalcohols (B3) include ethanol amines, and hydroxyethylanilines. Examples of the amino mercaptans (B4) include aminoethyl mercaptan, and aminopropyl mercaptan. Examples of the amino acids (B5) include aminopropionic acid, aminocaproic acid, and the like. Examples of the compounds in which an amino group of B1 to B5 is blocked (B6) include ketimine compounds obtained from the above-noted amines of B1 to B5 and ketones such as acetone, methyl ethyl ketone, and mehyl isobuthyl ketone and oxazolidine compounds, and the like. Among these amines (B), divalent amine compounds B1 and mixtures of B1 with a small amount of a trivalent or more polyvalent amine compound (B2) are preferable.

The ratio of amines (B), defined as an equivalent ratio [NCO]/[NHx] of isocyanate group [NCO] in a polyester prepolymer having isocyanate group (A) to amine group [NHx] in amines (B), is typically 1/2 to 2/1, preferably 1.5/1 to 1/1.5, and more preferably 1.2/1 to 1/1.2. When [NCO]/[NHx] is more than 2 or less than 1/2, the molecular mass of urea modified polyester lowers, resulting in degraded anti-hot-offset property.

In addition, the urea modified polyester may include a urethane bond as well as a urea bond. A molar ratio of the urea bond content to the urethane bond content is typically 100/0 to 10/90, preferably 80/20 to 20/80, and more preferably 60/40 to 30/70. When a molar ratio of the urea bond is less than 10%, anti-hot-offset property degrades.

A urea-modified polyester (i) used in the present invention is produced by one-shot method, and prepolymer method. The mass average molecular mass of the urea-modified polyester (i) is typically 10,000 or more, preferably 20,000 to 10,000,000 and more preferably 30,000 to 1,000,000. The molecular mass peak at the time is preferably 1,000 to 10,000, and when less than 1,000, it is hard to be subjected to elongation reactions, and the elasticity of the toner is low, resulting in degraded hot-offset resistivity. When the molecular mass peak is more than 10,000, it may cause degradation of fixability and may bring hard challenges in yielding toner fine particles and in grinding.

In cross-linking and/or elongation reactions of a polyester prepolymer (A) and amines in order to obtain a modified polyester (i), a reaction stopper may be used as required to control the molecular mass of a urea-modified polyester to be obtained. Examples of the reaction stopper include monoamines such as diethyl amines, dibutyl amine, buthyl amine, and lauryl amine: and compounds in which the above-noted elements are blocked, i.e. ketimine compounds.

—Colorant—

With respect to the chromatic colorant used in the toner according to the present invention, all the dyes and pigments known in the art may be used. Examples of low-molecular-mass or low crystalline organic pigments and dyes used for the toner of the present invention include naphthol yellow S, Hansa yellow (10G, 5G, and G), polyazo yellow, oil yellow, Hansa yellow (GR, A, RN, R), pigment yellow L, benzidine yellow (G, GR), permanent yellow (NCG), vulcan fast yellow (5G, R), tartrazinelake yellow, quinoline yellow lake, anthraene yellow BGL, isoindolinon yellow, permanent red 4R, parared, fiser red, parachloroorthonitro anilin red, lithol fast scarlet G, brilliant fast scarlet, brilliant carmine BS, permanent red (F2R, F4R, FRL, FRLL, F4RH), fast scarlet VD, vulcan fast rubin B, brilliant scarlet G, lithol rubin GX, permanent red F5R, brilliant carmin 6B, pigment scarlet 3B, bordeaux 5B, toluidine Maroon, permanent bordeaux F2K, Helio bordeaux BL, bordeaux 10B, BON maroon light, BON maroon medium, eosin lake, rhodamine lake B, rhodamine lake Y, alizarin lake, thioindigo red B, thioindigo maroon, oil red, quinacridon red, pyrazolone red, polyazo red, chrome vermilion, benzidine orange, perinone orange, oil orange, cobalt blue, cerulean blue, alkali blue lake, peacock blue lake, victoria blue lake, metal-free phthalocyanin blue, phthalocyanin blue, fast sky blue, indanthrene blue (RS, BC), indigo, ultramarine, iron blue, anthraquinon blue, fast violet B, methylviolet lake, cobalt purple, manganese Violet, dioxane violet, anthraquinon violet, pigment green B, naphthol green B, green gold, acid green lake, malachite green lake, phthalocyanine green, anthraquinon green, and a mixture thereof.

The colorant content to 100 parts by mass of the binder resin is preferably 0.1 part by mass to 15 parts by mass.

These colorants may be used alone or in combination of two or more for color toning. Among these colorants, examples of the colorant of cyan toner preferably used in the present invention include C. I. Pigment Blue 15, C. I. Pigment Blue 15:1, C. I. Pigment Blue 15:2, C. I. Pigment Blue 15:3 and C. I. Pigment Blue 15.4. Particularly, C. I. Pigment Blue 15.4 is preferable.

Examples of the colorant of magenta toner preferably used in the present invention include C. I. Pigment Red 57:1, C. I. Pigment Violet 19, Red 122, C. I. Pigment Red 146, C. I. Pigment Red 147, C. I. Pigment Red 176, C. I. Pigment Red 184, C. I. Pigment Red 185 adn C. I. Pigment Red 269. Among them, C. I. Pigment Red 57:1, C. I. Pigment Violet 19, Red 122 and C. I. Pigment Red 269 are preferable.

Examples of the colorant of yellow toner preferably used in the present invention include C. I. Pigment Yellow 185, C. I. Pigment Yellow 74, C. I. Pigment Yellow 93, C. I. Pigment Yellow 128, C. I. Pigment Yellow 155 and C. I. Pigment Yellow 180. Among them, C. I. Pigment Yellow 155, C. I. Pigment Yellow 180 and C. I. Pigment Yellow 185 are preferable.

The colorants may be used as a masterbatch which is compounded with a resin. Examples of the binder resin to be used in producing a masterbatch, or to be kneaded with a masterbatch include styrenes such as polystyrene, poly-p-chlorostyrene, polyvinyl toluene, and polymers of derivative substitutions thereof, or copolymers of the above-noted styrene and vinyl compounds, polymethyl methacrylate, polybutyl methacrylate, polyvinylchloride, polyvinyl acetate, polyethylene, polypropylene, polyester, epoxy resins, epoxy polyol resins, polyurethane, polyamide, polyvinyl butyral, polyacrylic acid resins, rodin, modified-rodin, terpene resins, aliphatic hydrocarbon resins, alicyclic hydrocarbon resins, aromatic petroleum resins, chlorinated paraffins, and paraffin waxes. Each of these colorants may be employed alone or in combination of two or more.

—Releasing Agent—

For the releasing agent, a wax having a low melting point of 50° C. to 120° C. which is dispersed in a binder resin more effectively works on the phase boundary between a fixing roller and a toner as a releasing agent in a dispersion liquid with a binder resin dispersed therein, which exert effect on high temperature offsets without any applications of a releasing agent such as oil to a fixing roller. The wax components are as follows. Examples of the wax include vegetable waxes such as carnauba waxes, cotton waxes, Japanese waxes and rice waxes; animal waxes such as beeswaxes and lanoline waxes, and mineral waxes such as montan waxes, ozokerites and ceresins, and petroleum waxes such as paraffins, micro crystallines and petrolatums. Besides the above-noted permanent waxes, there are hydrocarbon synthetic waxes such as Fischer-Tropsch waxes, and polyethylene waxes; and synthetic waxes such as ester wax, ketone waxes, and ether waxes. Further, it is also possible to use fatty acid amides such as 12-hydroxy stearic acid amides, stearic acid amide, phthalic anhydride imide, and chlorinated hydrocarbons; and crystalline polymers having a long alkyl group in its side chain such as homopolymers or copolymers of polyacrylate such as poly-n-stearyl methacrylate, and poly-n-lauryl methacrylate which are low-molecular-mass crystalline polymer resins. Among them, it is preferable to use de-free fatty acid carnauba waxes, montan waxes, oxidized rice waxes alone or in combination, more specifically to use the microcrystallized carnuba waxes with an acid value of not greater than 5 or microcrystallized montan waxes with an acid value in the range of 5 to 14 in order to increase the dispersion properties of the releasing agent.

—Charge Controlling Agent—

As charge controlling agents, those in the art may be used. Examples of the charge controlling agents include nigrosine dyes, triphenylmethane dyes, chrome-contained metal-complex dyes, molybdic acid chelate pigments, rhodamine dyes, alkoxy amines, quaternary ammonium salts including fluoride-modified quaternary ammonium salts, alkylamides, phosphoric simple substance or compounds thereof, tungsten simple substance or compounds thereof, fluoride activators, salicylic acid metallic salts, and salicylic acid derivative metallic salts. Specifically, Bontron 03 being a nigrosine dye, Bontron P-51 being a quaternary ammonium salt, Bontron S-34 being a metal containing azo dye, Bontron E-82 being an oxynaphthoic acid metal complex, Bontron E-84 being a salicylic acid metal complrex, and Bontron E-89 being a phenol condensate (manufactured by Orient Chemical Industries, Ltd.); TP-302 and TP-415 being a quaternary ammonium salt molybdenum metal complex (manufactured by HODOGAYA CHEMICAL CO., LTD.); Copy Charge PSY VP2038 being a quaternary ammonium salt, Copy Blue PR being a triphenylmethane derivative, and Copy Charge NEG VP2036 and Copy Charge NX VP434 being a quaternary ammonium salt (manufactured by Hoechst Ltd.); LRA-901, and LR-147 being a boron metal complex (manufactured by Japan Carlit Co., Ltd.), copper phtalocyamine, perylene, quinacridone, azo pigments, and other high-molecular mass compounds having a functional group such as a sulfonic acid group, a carboxyl group, and a quaternary ammonium salt. Among the charge controlling agents, a substance capable of controlling a toner to a negative polarity is preferably used.

The usage of the charge controlling agent is determined depending on the type of the binder resin, presence or absence of an additive to be used as required, and the method for producing a toner including a dispersion process and is not limited uniformly, however, to 100 parts by mass of binder resin, 0.1 parts by mass to 10 parts by mass of the charge controlling agent is preferably used and more preferably with 0.2 parts by mass to 5 parts by mass of the charge controlling agent. When the charge controlling agent is more than 10 parts by mass, toner's charge properties are exceedingly large, which lessens the effect of the charge controlling agent itself and increases in electrostatic attraction force with a developing roller, and causes degradations of fluidity and image density of developer.

<Example of Toner Production According to Dissolution Suspension Method>

Next, the toner production method of the present invention will be described. A preferred example of the toner production method is described below, however, the present invention is not limited to the example.

1) A colorant, an unmodified polyester, a polyester prepolymer having an isocyanate group, and a releasing agent are dispersed into an organic solvent to prepare a toner materials-contained solution.

Wax as a releasing agent is melted in an organic solvent, and then stirred to form releasing agent particles. In this way, the particle diameter of the releasing agent is adjusted by stirring. The obtained particles are added to the organic solvent along with a binder resin.

As to the organic solvent, an organic solvent being volatile with a boiling point less than 100° C. is preferable in terms of ease of removability after toner base particles being formed. Specifically, toluene, xylene, benzene, carbon tetrachloride, methylene chloride, 1, 2-dichloroethane, 1,1,2-trichloroethane, trichloroethylene, chloroform, monochlorobenzene, dichloroethylidene, methyl acetate, ethyl acetate, methyl ethyl ketone, methyl isobutyl ketone and the like may be used alone or in combination with two or more. Particularly, aromatic solvents such as toluene, xylene, and halogenated hydrocarbons such as methylene chloride, 1,2-dichloroethane, chloroform, carbon tetrachloride are preferable. The usage of the organic solvent to 100 parts by mass of the polyester prepolymer is preferably 0 part by mass to 300 parts by mass, more preferably 0 part by mass to 100 parts by mass, and still more preferably 25 parts by mass to 70 parts by mass.

2) The toner materials-contained solution is emulsified in an aqueous medium in the presence of a surface active agent and resin fine particles. The aqueous medium may be water alone or may comprise an organic solvent which comprises alcohols such as methanol, isopropyl alcohol, and ethylene glycol; dimethylformamide; tetrahydrofuran; and Cellosolves such as methyl cellosolve; and lower ketone such as acetone, and methyl ethyl ketone.

The amount of the aqueous medium for use is preferably 50 parts by mass to 2,000 parts by mass, and more preferably 100 parts by mass to 1,000 parts by mass relative to 100 parts by mass of the toner materials-contained solution. When the amount of aqueous medium is less than 50 parts by mass, the toner materials-contained solution may not be dispersed sufficiently, and the resulting toner particles may not have a predetermined average particle diameter. When it is more than 2,000 parts by mass, it is not unfavorable in terms of cost reduction.

Dispersing agents such as surface active agents and resin fine particles can be used arbitrarily for better particle size distribution and more stable dispersion in the aqueous medium.

Examples of the surface active agents include anionic surface active agents such as alkyl benzene sulphonates, α-olefin sulphonates, and phosphoric esters; amine salts cationic surface active agents such as alkylamine salts, amino alcohol fatty acid derivatives, polyamine fatty acid derivatives, and imidazoline; quaternary ammonium salts cationic surface active agents such as alkyltrimethylammonium salts, dialkyldimethylammonium salts, alkyldimethylbenzylammonium salts, pyridinium salts, alkylisoquinolium salts, and benzethonium chloride; nonionic surface active agents such as fatty acid amide derivatives, and polyhydric alcohol derivatives; and amphoteric surface active agents such as alanine, dodecyldi(aminoethyl) glycine, di(octylaminoethyl) glycine, N-alkyl-N,N-dimethylammonium betaine.

The effects of the surface active agents can be obtained in a small amount by using a surface active agent having a fluoroalkyl group. Preferred examples of anionic surface active agents having a fluoroalkyl group include fluoroalkyl carboxylic acids (C2 to C10) and metallic salts thereof, disodium perfluorooctanesulfonyl glutaminate, sodium 3-[ω-fluoroalkyl (C6 to C11)oxy]-1-alkyl(C3 to C4)sulfonate, sodium 3-[ω-fluoroalkanoyl (C6 to C8)-N-ethylamino]-1-propane sulfonate, fluoroalkyl (C11 to C20) carboxylic acids and metallic salts thereof, perfluoroalkyl carboxylic acids (C7 to C13), and metallic salts thereof, perfluoroalkyl (C4 to C12) sulfonic acids and metallic salts thereof, perfluorooctanesulfonic acid diethanolamide, N-propyl-N-(2-hydroxyethyl) perfluorooctanesulfonamide, perfluoroalkyl (C6 to C10) sulfonamide propyl trimethyl ammonium salts, perfluoroalkyl (C6 to C10)-N-ethylsulfonyl glycine salts, and monoperfluoroalkyl (C6 to C16) ethyl phosphoric esters.

Such fluoroalkyl-containing anionic surface active agents are commercially available under the trade names of, for example, Surflon S-111, S-112, and S-113 (manufactured by ASAHI GLASS CO., LTD.); Fluorad FC-93, FC-95, FC-98, and FC-129 (manufactured by Sumitomo 3M Ltd.); Unidyne DS-101, and DS-102 (manufactured by DAIKIN INDUSTRIES, LTD.); Megafac F-110, F-120, F-113, F-191, F-812, and F-833 (manufactured by Dainippon Ink & Chemicals, Inc.); ECTOP EF-102, 103, 104, 105, 112, 123A, 123B, 306A, 501, 201, and 204 (manufactured by Tohchem Products); and FTERGENT F-100 and F150 (manufactured by NEOS Co., Ltd).

Examples of fluoroalkyl-containing cationic surface active agents for use in the present invention include aliphatic primary, secondary and tertiary amic acids each having a fluoroalkyl group; aliphatic quaternary ammonium salts such as perfluoroalkyl having 6 to 10 carbon atoms sulfonamide propyltrimethyl ammonium salts; benzalkonium salts, benzethonium chloride, pyridinium salts, and imidazolium salts. Such fluoroalkyl-containing cationic surface active agents are commercially available, for example, under the trade names of Surflon S-121 (manufactured by ASAHI GLASS CO., LTD.); FLUORAD FC-135 (manufactured by Sumitomo 3M Ltd.); Unidyne DS-202 (manufactured by DAIKIN INDUSTRIES, LTD.); Megafac F-150, and F-824 (manufactured by Dainippon Ink & Chemicals, Inc.); ECTOP EF-132 (manufactured by Tohchem Products); and FTERGENT F-300 (manufactured by NEOS Co., Ltd).

The resin fine particles are used for stabilizing the toner-base particles to be formed in the aqueous medium. To this end, it is preferable to add resin fine particles so that each toner base particle has a surface coverage of 10% to 90%. Examples of such resin fine particles include 1 μm and 3 μm of poly(methyl methacrylate) fine particles, 0.5 μm and 2 μm of polystyrene fine particles, and 1 μm of poly(styrene-acrylonitrile) fine particles. These resin fine particles are commercially available, for example, under the trade names of PB-200H (manufactured by KAO CORPORATION); SGP (manufactured by Soken Chemical & Engineering Co., Ltd.); Techno Polymer SB (manufactured by SEKISUI CHEMI- CAL CO., LTD.); SGP-3G (manufactured by Soken Chemical & Engineering Co., Ltd.); and Micro Pearl (manufactured by SEKISUI CHEMICAL CO., LTD.).

Inorganic compounds such as tricalcium phosphate, calcium carbonate, titanium oxide, colloidal silica, and hydroxyl apatite can also be used as the dispersant.

For further stabilizing the primary particles in the dispersion, a polymeric protective colloid can be used as a dispersing agent in combination with any of the resin fine particles and inorganic compound dispersing agent. Examples of the polymeric protective colloid include homopolymers and copolymers of acids such as acrylic acid, methacrylic acid, α-cyanoacrylic acid, α-cyanomethacrylic acid, itaconic acid, crotonic acid, fumaric acid, maleic acid, and maleic anhydride; hydroxyl-group-containing (meth)acrylic monomers such as β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylic ester, diethylene glycol monomethacrylic ester, glycerol monoacrylic ester, glycerol monomethacrylic ester, N-methylolacrylamide, and N-methylolmethacrylamide; vinyl alcohol and ethers thereof such as vinyl methyl ether, vinyl ethyl ether, and vinyl propyl ether; esters of vinyl alcohol and a carboxyl-group-containing compound such as vinyl acetate, vinyl propionate, and vinyl butyrate; acrylamide, methacrylamide, diacetone acrylamide, and methylol compounds thereof; acid chlorides such as acryloyl chloride, and methacryloyl chloride; nitrogen-containing or heterocyclic compounds such as vinylpyridine, vinylpyrrolidone, vinylimidazole, and ethyleneimine; polyoxyethylene compounds such as polyoxyethylene, polyoxypropylene, polyoxyethylene alkyl amines, polyoxypropylene alkyl amines, polyoxyethylene alkyl amides, polyoxypropylene alkyl amides, polyoxyethylene nonyl phenyl ether, polyoxyethylene lauryl phenyl ether, polyoxyethylene stearyl phenyl ester, and polyoxyethylene nonyl phenyl ester; and cellulose derivatives such as methyl cellulose, hydroxymethyl cellulose, and hydroxypropyl cellulose.

The dispersing procedure is not particularly limited, but may be suitably selected in accordance with the necessity. The dispersing temperature is typically from 0° C. to 150° C. under pressures, and preferably from 40° C. to 98° C.

3) In parallel with preparation of the emulsified liquid, amines (B) are added to the emulsified liquid to be reacted with a polyester prepolymer having an isocyanate group (A).

The reaction is involved in cross-linking and/or elongation of molecular chains. The reaction time for cross-linking and/or elongation is appropriately set depending on the reactivity derived from the combination of the isocyanate structure of the polyester prepolymer (A) and the amines (B) and is typically from 10 minutes to 40 hours, and preferably 2 hours to 24 hours. The reaction temperature is generally 0° C. to 150° C., and preferably 40° C. to 98° C. In accordance with the necessity, a catalyst known in the art may be used. Specifically, examples of the catalyst include dibutyltin laurates, and diocryltin laurates.

4) Upon completion of the reaction, the organic solvent is removed from the emulsified dispersion liquid, i.e. reactant and the residue is rinsed and dried to obtain toner base particles.

The entire system is gradually raised in temperature while stirring as a laminar flow, vigorously stirred at a constant temperature, and the organic solvent is removed to thereby yield toner base particles. When a substance that is soluble in acid or alkali such as calcium phosphate salts is used as a dispersion stabilizer, the dispersion stabilizer is removed from the fine particles by dissolving the dispersion stabilizer by action of an acid such as hydrochloric acid and washing the fine particles. Alternatively, the component can be removed, for example, by enzymatic decomposition.

5) A charge-controlling agent is implanted into the obtained toner base particles, and then inorganic fine particles such as silica fine particles, and titanium oxide fine particles are added to the toner base particles as external additives and thereby yield a toner.

The implantation of a charge-controlling agent and the external addition of inorganic particles are performed according to conventional procedures using such as a mixer.

Thus, a toner having a small particle diameter with sharp particle size distribution can be easily obtained without substantial variation of particle size distribution. By applying strong agitation to the emulsified dispersion liquid in the step of removing the organic solvent, it is possible to control the toner shape from a perfect spherical shape to a rugby-ball shape. In addition, surfaces of the toner base particles can be morphologically controlled within ranges from smooth surface to shriveled surface.

<Image Forming Apparatus>

An image forming apparatus according to the present invention comprises a latent electrostatic image bearing member; a charging unit configured to uniformly charge a surface of the image bearing member; an exposing unit configured to form a latent electrostatic image on the surface of the charged image bearing member; a developing unit configured to supply a toner to the latent electrostatic image formed on the surface of the image bearing member to form a visible image; a transferring unit configured to transfer the visible image formed on the surface of the image bearing member to a recording medium; a fixing unit configured to fix the visible image on the recording medium by application of at least one of heat and puressure; a cleaning unit configured to clean a residual toner on the imge bearing member; and a toner replenishing device configured to replenish the toner to the developing unit.

Figure 3:
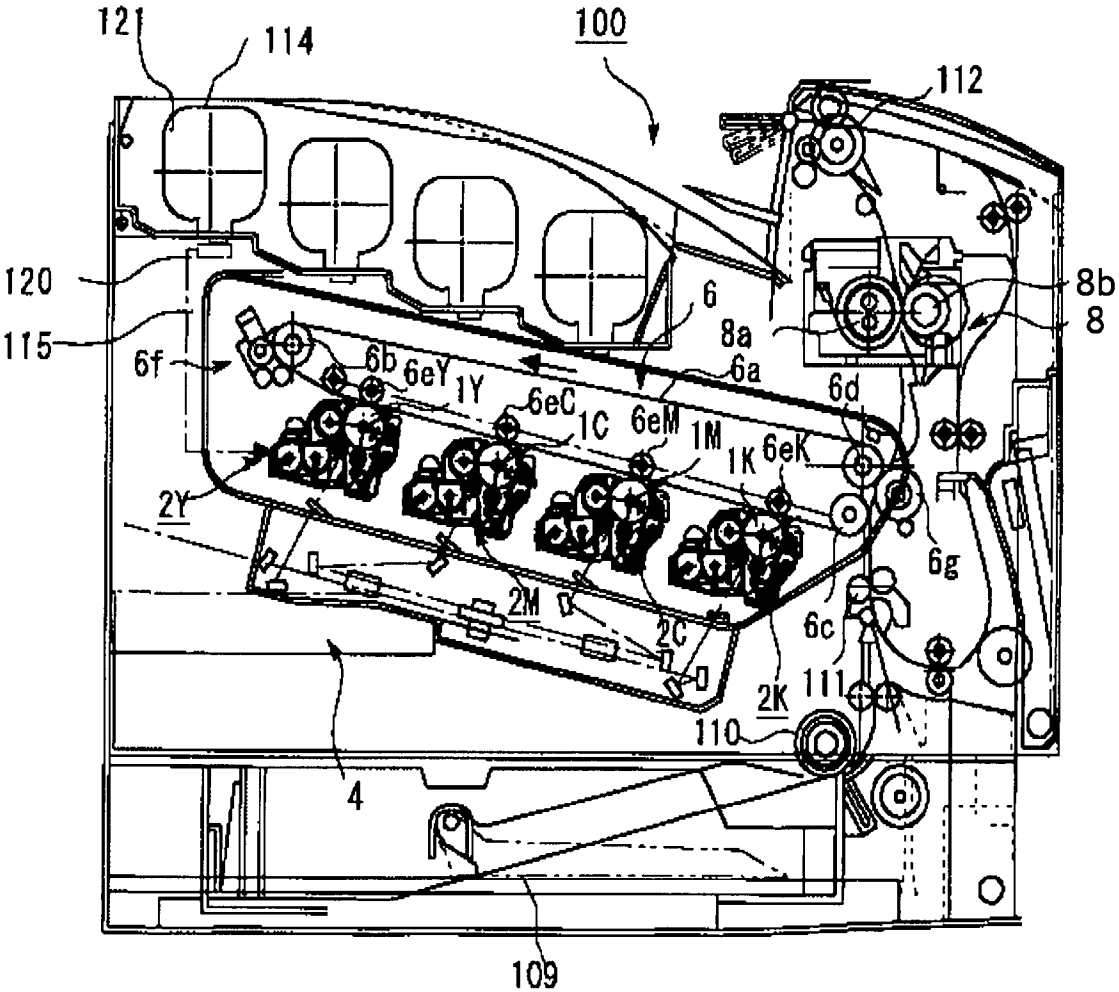
FIG. 3 is a diagram schematically showing an example of the image forming apparatus according to the present invention.

Coincidentally, the image forming apparatus according to the present invention comprises the above-mentioned toner and the toner replenishing device. FIG. 3 is a diagram schematically showing the image forming apparatus of the present invention. Arranged around a photoconductor 1 (an image bearing member) are a charging unit 3, an exposing unit 4, a developing unit 5, a transferring unit 6, a cleaning unit 7, and fixing unit 8.

The photoconductor 1 has a photosensitive layer on a belt-shaped or drum-shaped aluminum substrate. As the photosensitive layer, use is made of amorphous selenium, photoconductive perylenes, phthalocyanine organic compounds, or amorphous silicon.

The charging unit 3 uniformly charges the surface of the photoconductor 1. The charging unit 3 according to the embodiment has a charging roller 3*a* as a charging member to accomplish a negative charge in a so-called "contact or proximity charging method."

The surface of the photoconductor 1 is charged in this manner, and then exposed by the exposing unit 4 to form latent electrostatic images individually corresponding to each color. The exposing unit 4 writes the latent electrostatic images corresponding to each color on the photoconductor 1 based on the image information corresponding to each color. In addition, although the exposing unit 4 of the embodiment utilizes a laser, other exposing unit such as a unit comprised of an LED array and an imaging unit may be used.

Said exposoing unit 4 converts the data read by a scanner in a reading unit 20 and image signals transmitted from external devices such as computers, not shown in the figure, and have a polygon motor scan a laser light 3*a* form a latent electrostatic image on the photoconductor 1 based on the image signals read through a mirror.

The developing unit 5 has a hollow cylindrical developer carrier 5*a* for carrying a developer to supply the photoconductor 1, a toner supply chamber, and a developer control member to control the amount of developer, etc. The developer carrier 5*a* is arranged slightly detached from the photoconductor 1 and rotatably held. The developer carrier 5*a* has a magnet roll fixed with the same axis thereof inside of the developer carrier 5*a*, the developer is magnetically attached on the surface of the outer circumference of the developer carrier 5*a* to be transferred. The developer carrier 5*a* is made from a conductive and non-magnetic material and is connected to a power source to apply a development bias.

Coincidentally, although the developing unit utilizing a two-component developer was explained, the present invention is not limited to this case and, therefore, a developin unit utilizing a one-component developer may be used.

Said transferring unit 6 comprises a transfer belt 6*a*, a transfer bias roller 6*b* and a tension roller 6*c*. The transfer bias roller 6*b* is constructed by providing an elastic layer on a core metal surface such as iron, aluminum and stainless-steel. For the transfer bias roller 6*b*, to closely contact a recording sheet on the photoconductor 1, an appropriate pressure is applied to the photoconductor 1 side. It is effective to select various types of heat-resistant materials as the base of the transfer belt 6*a*. For example, it may be constituted with a seamless polyimido film. On the outside, it can be constituted with a fluorine resin layer. Furthermore, a silicone rubber layer may be overlaid on the top of the polyimidofilm and the fluorine resin layer overlaid thereon, if necessary. The tension roller 6*c* is arranged to drive and tension the transfer belt 6*a* inside of the transfer belt 6*a*.

The fixing unit 8 is comprised of a fixing roller with a heater such as a halogen lamp and a pressure roller for pressuring. The fixing roller has an elastic layer made from, for example, silicone rubber provided on a core metal surface with a thickness of 100 μm to 500 μm, more preferably 400 μm, and furthermore, a resin surface layer with good release properties, such as fluorine resin is formed to prevent sticky toner from adhering. The resin surface layer is made of, for example, a PFA tube, and it is preferable to have a thickness of approximately 10 μm to 50 μm, considering mechanical deterioration.

<Process Cartridge>

The process cartridge according to the present invention comprises an image bearing member; and at least one unit selected from the group consisnting of a charging unit, a developing unit and cleaning unit, and the process cartridge is integrated with the image bearing member and at least one unit selected from the group consisting of the charging unit, the developing unit and the cleaning unit, which is provided detachably in an image forming apparatus, and a toner used in the process cartridge comprises a binder resinm, a colorant and a releasing agent and has a dynamic friction coefficient of 0.15 to 0.35.

The process cartridge of the present invention can be mounted in various types of image forming apparatuses and it is preferable for it to be mounted in the image forming apparatus of the present invention.

Figure 4:
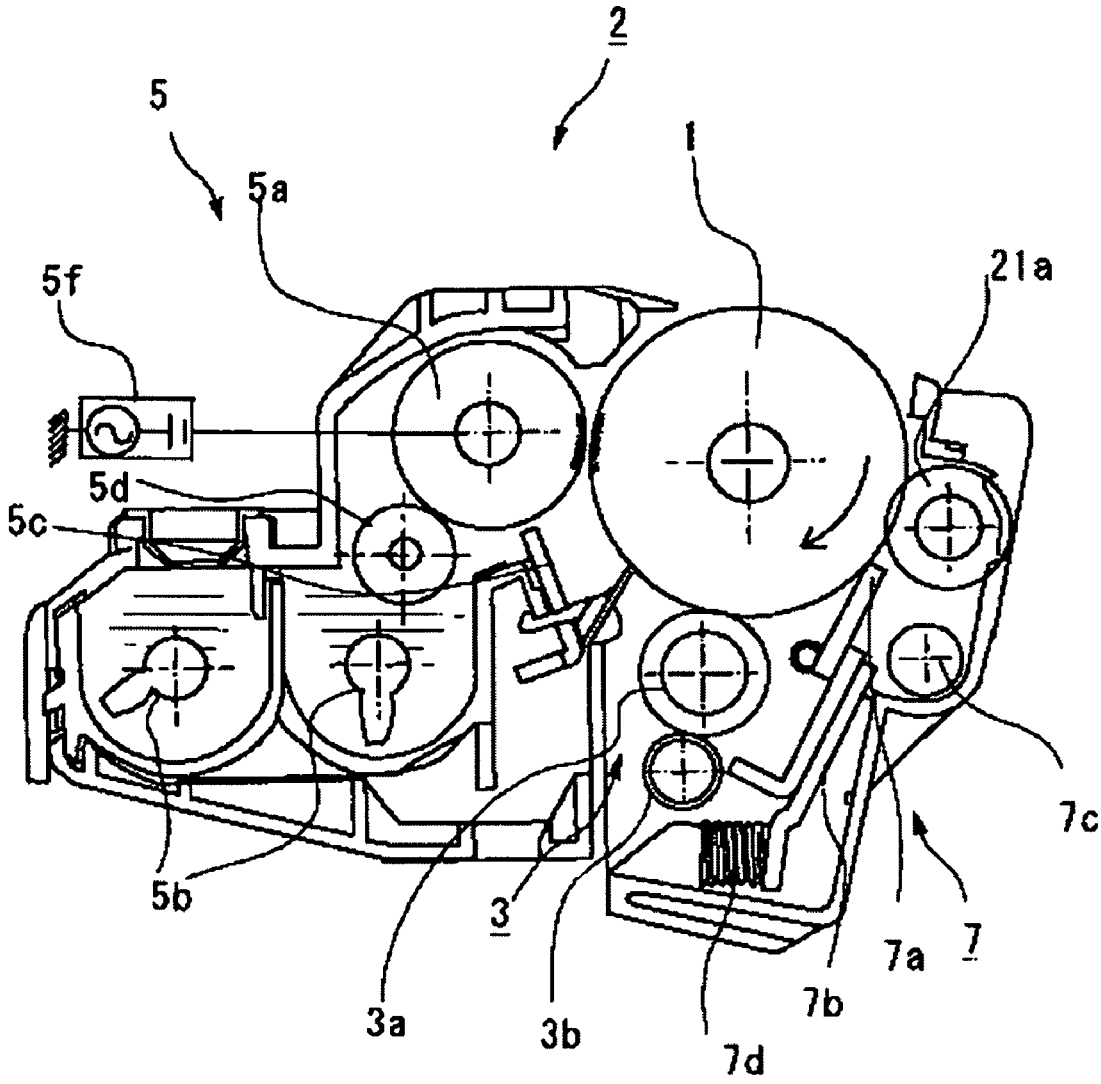
FIG. 4 is a diagram showing a process cartridge of the image forming apparatus in FIG. 1.

As shown in FIG. 4, the image forming apparatus 100 of the present invention comprises a detachable process cartridge 2 in which a photoconductor 1 and at least one unit selected from group consisting of a charging unit 3, a developing unit 5 and a cleaning unit 7 are held. This makes it easy to replace a developer and the developing unit 5 and to increase the machine life of the main body of the image forming apparatus 100.

According to the present invention, the toner containing a chromatic colorant and a releasing agent with glossy and highly accurate and reproducibly can be stably replenished by a toner replenishing device using a power pump.

In addition, the image forming apparatus according to the present invention reproduces glossy and highly accurate images by using the toner replenishing device to stably replenish toner containing the releasing agent.

Hereinafter, the present invention will be described referring to specific examples; however, the present invention is not limited to the disclosed examples. It is also noted that parts or part described below means parts by mass or part by mass, and % means % by mass.

<Synthesis of Linear Polyester Resin>

To a reaction vessel equipped with a condenser, a stirrer, and a nitrogen inlet tube, 320 parts of bisphenol A•EO dimolar adduct, 480 parts of bisphenol A•EO dimolar adduct, 200 parts of terephthalic acid, 65 parts of fumaric acid, and 2 parts of potassium titanyl oxalate as a polycondensation catalyst were poured, and the reaction was performed while distilling produced water away under nitrogen gas stream at 220° C. for 10 hours. Next, the reaction was performed under reduced pressures of 5 mmHg to 20 mmHg, then cooled to room temperature and crushed to thereby obtain a linear polyester resin M-1.

The linear polyester resin M-1 did not contain tetrahydrofuran insoluble component and had an acid value of 13, a hydroxyl group value of 40, a glass transition temperature (Tg) of 58° C., a number average molecular mass (Mn) of 5,000, a mass average molecular mass (Mw) of 22,000, and a peak top molecular mass of 4,400.

<Preparation of Masterbatch>

Using the linear polyester resin M-1, pigments, the polyester resin, and pure water were mixed at a mixing ratio of 1:1:0.5 and kneaded with two rollers. The kneading was performed at 70° C., and then the roller temperature was raised to 120° C. to evaporate water to thereby produce a masterbatch preliminarily.

<Prescription of Cyan Toner Masterbatch: (TB-C)>

| | |
|---|---|
| Binder resin M-1 | 100 parts |
| Cyan pigment (pigment blue 15:3) | 100 parts |
| Pure water | 50 parts |

<Prescription of Magenta Toner Masterbatch: (TB-M)>

| | |
|---|---|
| Binder resin M-1 | 100 parts |
| Magenta pigment (pigment red 122) | 100 parts |
| Pure water | 50 parts |

<Prescription of Yellow Toner Masterbatch: (TB-Y)>

| | |
|---|---|
| Binder resin M-1 | 100 parts |
| Yellow pigment (pigment yellow 180) | 100 parts |
| Pure water | 50 parts |

<Prescription of Black Toner Masterbatch: (TB-K)>

| | |
|---|---|
| Binder resin M-1 | 100 parts |
| Black pigment (carbon black) | 100 parts |
| Pure water | 50 parts |

<Production of Nonlinear Polyester Resin>

To a reaction vessel equipped with a condenser tube, a stirrer, and a nitrogen inlet tube, 400 parts of bisphenol A•EO dimolar adduct, 269 parts of bisphenol A•PO trimolar adduct, 50 parts of trimellitic acid, 278 parts of terephthalic acid, 40 parts of anhydrous phthalic acid, and 2 parts of potassium titanyl oxalate as a polycondensation catalyst were poured, and the reaction was performed while distilling produced water away under nitrogen gas stream at 230° C. for 10 hours. Next, the reaction was performed under reduced pressures of 5 mmHg to 20 mmHg, and when the acid value of the reactant was 10 or less, it was cooled to 180° C., then 10 parts of anhydrous trimellitic acid were added thereto, and the reaction was performed under sealed and normal pressure for 2 hours. After the reaction, the reactant was taken out from the reaction vessel, then cooled to room temperature and crushed to thereby obtain nonlinear polyester resin H-1.

The nonlinear polyester resin H-1 contained 5% tetrahydrofuran insoluble component and had an acid value of 22, a hydroxy group value of 67, a glass transition temperature (Tg) of 70° C., a number average molecular mass (Mn) of 9,600, a mass average molecular mass of (Mw) 45,000, and a peak top molecular mass of 11,000.

EXAMPLES 1 to 3

<Prescription of Cyan Toner>

| | |
|---|---|
| Linear polyester resin M-1 | 50 parts |
| Nonlinear polyester resin H-1 | 50 parts |
| Masterbatch (TB-C) | 20 parts |
| E-84 (salicylic acid zinc complex, manufactured by Orient Chemical Industries, Ltd.) | 1 part |
| Ester wax (acid value: 5 mgKOH/g, Mw: 1600, particle size: 120 μm) | 3 parts |

<Prescription of Magenta Toner>

A magenta toner was produced with the the same prescription of the cyan toner except that the content of the masterbatch (TB-M) was changed to 18 parts.

<Prescription of Yellow Toner>

A yellow toner was produced with the same prescription of the cyan toner except that the content of the masterbatch (TB-Y) was changed to 20 parts.

<Prescription of Black Toner>

A black toner was produced with the same prescription of the cyan toner except that the content of the masterbatch (TB-K) was changed to 16 parts.

According to the above prescriptions, the materials were pre-mixed with a Herschel mixer (FM10B, manufactured by Mitsui Miike Machinery Co., Ltd.) and kneaded with a biaxial extruder (PCM-30, manufactured by Ikegai Corp.) by maintaining the temperature of the paste mixture at 120° C. Next, the obtained products were finely pulverized using a supersonic jet pulverizer Lab Jet (manufactured by Nippon Pneumatic Mfg. Co., Ltd) and classified with an air classifier (MDS-1, manufactured by Nippon Pneumatic Mfg. Co., Ltd.) to obtained toner particles with a volume-average particle diameter of 7 μm.

The toners of Examples 1, 2 and 3 were obtained by mixing 100 parts of the obtained toner particles with 1.0 part of hydrophobic colloidal silica using a sample mill, respectively, with a variety of volume-average diameters of primary particles shown in Table 1. The volume-average diameter of primary particles were measured by taking a image (10,000×) by SEM (scanning electron microscope) and measuring diameters of 100 particles of the external additive on the toner surface by using a micrometer caliper to find the average diameter.

EXAMPLE 4

<Synthesis of Linear Polyester Resin>

To a reaction vessel equipped with a condenser, a stirrer, and a nitrogen inlet tube, 260 parts of bisphenol A•PO dimolar adduct, 200 parts of bisphenol A•PO trimolar adduct, 312 parts of terephthalic acid, 65 parts of isophthalic acid, 10 parts of maleic anhydride, and 3 parts of dibutyltin oxide as a polycondensation catalyst were poured, and the reaction was performed while distilling produced water away under nitrogen gas stream at 220° C. for 10 hours. Next, the reaction was performed under reduced pressures of 5 mmHg to 20 mmHg, and when the acid value of the reactant was 5, it was taken out from the reaction vessel, then cooled to room temperature and crushed to thereby obtain linear polyester resin M-2.

The linear polyester resin M-2 did not contain tetrahydrofuran insoluble component and had an acid value of 8, a hydroxyl group value of 22, a glass transition temperature (Tg) of 59° C., a number average molecular mass (Mn) of 7,890, a mass average molecular mass (Mw) of 52,100, and a peak top molecular mass of 10,800.

<Prescription of Cyan Toner>

| | |
|---|---|
| Linear polyester resin M-2 | 100 parts |
| Masterbatch (TB-C) | 20 parts |
| TN-105 (manufactured by Hodogaya Chemical Co., Ltd.) | 1 part |
| Carnauba wax (particle size: 80 μm, acid value: 3 mgKOH/g, manufactured by Toagosei Co., Ltd.) | 5 parts |

<Prescription of Magenta Toner>

A magenta toner was produced with the the same prescription of the cyan toner except that the content of the masterbatch (TB-M) was changed to 18 parts.

<Prescription of Yellow Toner>

A yellow toner was produced with the same prescription of the cyan toner except that the content of the masterbatch (TB-Y) was changed to 20 parts.

<Prescription of Black Toner>

A black toner was produced with the same prescription of the cyan toner except that the content of the masterbatch (TB-K) was changed to 16 parts.

According to the above prescriptions, the materials were pre-mixed with a Herschel mixer (FM10B, manufactured by Mitsui Miike Machinery Co., Ltd.) and kneaded with a biaxial extruder (PCM-30, manufactured by Ikegai Corp.) by maintaining the temperature of the paste mixture at 100° C. Next, the obtained products were finely pulverized using a supersonic jet pulverizer Lab Jet (manufactured by Nippon Pneumatic Mfg. Co., Ltd) and classified with an air classifier (MDS-1, manufactured by Nippon Pneumatic Mfg. Co., Ltd.) to obtained toner particles with a volume-average particle diameter of 7 μm. The toner of Example 4 was obtained by mixing 100 parts of the obtained toner particles with 1.0 part of hydrophobic silica having a volume-average diameter of primary particles shown in Table 1, which was obtained according to the sol-gel method, using a sample mill.

EXAMPLE 5

<Synthesis of Linear Polyester Resin>

The same reaction as that of the linear polyester resin (M-1) of Example 1 was performed except that 5 parts of isooctane titanium tricarboxylic acid was used as the polycondensation catalyst, then cooled to room temperature and crushed to thereby obtain a linear polyester resin (M-3).

The linear polyester resin (M-3) did not contain tetrahydrofuran insoluble component and had an acid value of 7, a hydroxyl group value of 34, a glass transition temperature (Tg) of 58° C., a number average molecular mass (Mn) of 5,500, a mass average molecular mass (Mw) of 24,500, and a peak top molecular mass of 7,000.

<Synthesis of Nonlinear Polyester Resin>

The same reaction as that of the nonlinear polyester resin (H-1) of Example 1 was performed except that 5 parts of titanium terephthalate was used as the polycondensation catalyst, then cooled to room temperature and crushed to thereby obtain a nonlinear polyester resin (H-2).

The nonlinear polyester resin (H-2) contains 10% of tetrahydrofuran insoluble component and had an acid value of 2, a hydroxyl group value of 20, a glass transition temperature (Tg) of 56° C., a number average molecular mass (Mn) of 4,130, a mass average molecular mass (Mw) of 11,500, and a peak top molecular mass of 4,000.

<Prescription of Cyan Toner>

| | |
|---|---|
| Linear polyester resin M-3 | 80 parts |
| Nonlinear polyester resin H-2 | 20 parts |
| Masterbatch (TB-C) | 20 parts |
| Copy charge NX VP434 (manufactured by Hoechst Ltd.) | 2 parts |
| Linear ester wax (acid value: 7 mgKOH/g, Mw: 1,000, particle size: 30 μm) | 8 parts |

<Prescription of Magenta Toner>

A magenta toner was produced with the same prescription of the cyan toner except that the content of the masterbatch (TB-M) was changed to 18 parts.

<Prescription of Yellow Toner>

A yellow toner was produced with the same prescription of the cyan toner except that the content of the masterbatch (TB-Y) was changed to 20 parts.

<Prescription of Black Toner>

A black toner was produced with the same prescription of the cyan toner except that the content of the masterbatch (TB-K) was changed to 16 parts.

According to the above prescriptions, the materials were pre-mixed with a Herschel mixer (FM10B, manufactured by Mitsui Miike Machinery Co., Ltd.) and kneaded with a biaxial extruder (PCM-30, manufactured by Ikegai Corp.) by maintaining the temperature of the paste mixture at 100° C. Next, the obtained products were finely pulverized using a supersonic jet pulverizer Lab Jet (manufactured by Nippon Pneumatic Mfg. Co., Ltd) and classified with an air classifier (MDS-1, manufactured by Nippon Pneumatic Mfg. Co., Ltd.) to obtained toner particles with a volume-average particle diameter of 7 μm. The toner of Example 5 was obtained by mixing 100 parts of the obtained toner particles with 1.0 part of hydrophobic silica having a volume-average diameter of primary particles shown in Table 1, which was obtained according to the sol-gel method, using a sample mill.

COMPARATIVE EXAMPLE 1

<Synthesis of Linear Polyester Resin>

The same reaction as that of the linear polyester resin (M-1) of Example 1 was performed except that 2 parts of dibuthltin oxide was used as the polycondensation catalyst, then cooled to room temperature and crushed to thereby obtain a linear polyester resin (Y-1).

The linear polyester resin Y-1 did not contain tetrahydrofuran insoluble component and had an acid value of 35, a hydroxyl group value of 35, a glass transition temperature (Tg) of 58° C., a number average molecular mass (Mn) of 5,400, a mass average molecular mass (Mw) of 14,000, and a peak top molecular mass of 7,300.

<Preparation of Masterbatch>

Using the linear polyester resin Y-1, pigments, the polyester resin, and pure water were mixed at a mixing ratio of 1:1:0.5 (mass ratio) and kneaded with two rollers. The kneading was performed at 120° C., and then the roller temperature was raised to 130° C. to evaporate water to thereby produce a masterbatch preliminarily.

<Prescription of Cyan Toner Masterbatch: (YB-C)>

| | |
|---|---|
| Binder resin Y-1 | 100 parts |
| Cyan pigment (pigment blue 15:3) | 100 parts |
| Pure water | 50 parts |

<Prescription of Magenta Toner Masterbatch: (YB-M)>

| | |
|---|---|
| Binder resin Y-1 | 100 parts |
| Magenta pigment (pigment red 122) | 100 parts |
| Pure water | 50 parts |

<Prescription of Yellow Toner Masterbatch: (YB-Y)>

| | |
|---|---|
| Binder resin Y-1 | 100 parts |
| Yellow pigment (pigment yellow 180) | 100 parts |
| Pure water | 50 parts |

<Prescription of Black Toner Masterbatch: (YB-K)>

| | |
|---|---|
| Binder resin Y-1 | 100 parts |
| Black pigment (carbon black) | 100 parts |
| Pure water | 50 parts |

<Prescription of Cyan Toner>

| | |
|---|---|
| Linear polyester resin Y-1 | 100 parts |
| Masterbatch (YB-C) | 20 parts |
| TN-105 (manufactured by Hodogaya Chemical Co., Ltd.) | 1 part |
| Branched ester wax (acid value: 7 mgKOH/g, Mw: 1,500, particle size: 150 μm) | 6 parts |

<Prescription of Magenta Toner>

A magenta toner was produced with the the same prescription of the cyan toner except that the content of the masterbatch (YB-M) was changed to 18 parts.

<Prescription of Yellow Toner>

A yellow toner was produced with the same prescription of the cyan toner except that the content of the masterbatch (YB-Y) was changed to 20 parts.

<Prescription of Black Toner>

A black toner was produced with the same prescription of the cyan toner except that the content of the masterbatch (YB-K) was changed to 16 parts.

According to the above prescriptions, the materials were pre-mixed with a Herschel mixer (FM10B, manufactured by Mitsui Miike Machinery Co., Ltd.) and kneaded with a biaxial extruder (PCM-30, manufactured by Ikegai Corp.) by maintaining the temperature of the paste mixture at 100° C. Next, the obtained products were finely pulverized using a supersonic jet pulverizer Lab Jet (manufactured by Nippon Pneumatic Mfg. Co., Ltd) and classified with an air classifier (MDS-1, manufactured by Nippon Pneumatic Mfg. Co., Ltd.) to obtained toner particles with a volume-average particle diameter of 7 μm. The toner of Comparative Example 1 was obtained by mixing 100 parts of the obtained toner particles with 1.0 part of hydrophobic silica having a volume-average diameter of primary particles shown in Table 1, which was obtained according to the sol-gel method, using a sample mill.

COMPARATIVE EXAMPLE 2

<Synthesis of Nonlinear Polyester Resin>

The same reaction as that of the nonlinear polyester resin (H-1) of Example 1 was performed except that 1.5 parts of dibuthltin oxide was used as the polycondensation catalyst, then cooled to room temperature and crushed to thereby obtain a nonlinear polyester resin (Y-2).

The nonlinear polyester resin (Y-2) contains 6% of tetrahydrofuran insoluble component and had an acid value of 34, a hydroxyl group value of 22, a glass transition temperature (Tg) of 60° C., a number average molecular mass (Mn) of 5,050, a mass average molecular mass (Mw) of 30,500, and a peak top molecular mass of 11,800.

<Prescription of Cyan Toner>

| | |
|---|---|
| Linear polyester resin Y-1 | 50 parts |
| Nonlinear polyester resin Y-2 | 50 parts |
| Masterbatch (YB-C) | 20 parts |
| Copy charge NX VP434 (manufactured by Hoechst Ltd.) | 2 parts |
| Linear ester wax (acid value: 10 mgKOH/g, Mw: 1,000, particle size: 30 μm) | 2 parts |

<Prescription of Magenta Toner>

A magenta toner was produced with the the same prescription of the cyan toner except that the content of the masterbatch (YB-M) was changed to 18 parts.

<Prescription of Yellow Toner>

A yellow toner was produced with the same prescription of the cyan toner except that the content of the masterbatch (YB-Y) was changed to 20 parts.

<Prescription of Black Toner>

A black toner was produced with the same prescription of the cyan toner except that the content of the masterbatch (YB-K) was changed to 16 parts.

According to the above prescriptions, the materials were pre-mixed with a Herschel mixer (FM10B, manufactured by Mitsui Miike Machinery Co., Ltd.) and kneaded with a biaxial extruder (PCM-30, manufactured by Ikegai Corp.) by maintaining the temperature of the paste mixture at 100° C. Next, the obtained products were finely pulverized using a supersonic jet pulverizer Lab Jet (manufactured by Nippon Pneumatic Mfg. Co., Ltd) and classified with an air classifier (MDS-1, manufactured by Nippon Pneumatic Mfg. Co., Ltd.) to obtained toner particles with a volume-average particle diameter of 7 μm. The toner of Comparative Example 2 was obtained by mixing 100 parts of the obtained toner particles with 1.0 part of hydrophobic silica having a volume-average diameter of primary particles shown in Table 1, which was obtained according to the sol-gel method, using a sample mill.

For each toner of Examples 1 to 5 and Comparative Examples 1 and 2, the dynamic friction coefficient of the toner, the dispersion diameter of the releasing agent, the volume-average particle diameter of the toner, and number percentage of the toner particles having a diameter of 0.7 μm to 2.0 μm were measured. The results are shown in Table 1.

<Dynamic Friction Coefficient of Toner>

The dynamic friction coefficient of a toner was measured using an automatic friction and abrasion analyzer manufactured by Kyowa Interface Science Co., Ltd. by using a disc-shaped pellet with a diameter of 40 mm after applying a load of 6 t/cm$^2$ to 3 g of toner sample. At this time, a point contact member, namely a stainless steel ball 3 mm in diameter was used as the contact member.

<Dispersion Diameter of the Releasing Agent>

The dispersion diameter of the releasing agent was measured by embedding the toner in an epoxy resin, preparing a thin slice sample of 0.1 μm with a diamond microtome, staining the sample with ruthenium, and observing the sample with a transmission electron microscope (H-9000NAR, accelerating voltage 300 kV, 4500x, manufactured by Hitachi, Ltd.). The difference between the minimum value and the maximum value of the diameter of the releasing agent from 100 images taken is used as the dispersion diameter.

<Volume-Average Particle Diameter of Toner and Number Percentage of Toner Particles Having Diameter of 0.7 μm to 2.0 μm>

The volume-average particle diameter of the toner and number percentage of the toner particles having a diameter of 0.7 μm to 2.0 μm were measured using a particle distribution measuring device by the Coulter counter method, namely a Coulter counter TA-II (Coulter Electronics Ltd.).

Next, each toner of Examples 1 to 5 and Comparative Examples 1 and 2 was filled in the toner container shown in FIG. 1 to form an image using the image forming apparatus shown in FIG. 3. A bag-type container of which the volume can be reduced by 85%, made from a 90 μm of a polyester film monolayer in thickness was used as a toner container. The toner was evaluated using the following criteria: toner replenishing performance; occurrence of white dots; image density; streak images; and non-uniform gloss.

The results are shown in Table 1.

<Toner Replenishing Performance>

The toner container containing the toner shown in Table 1 was mounted to the image forming apparatus for evaluation, and then, after waiting 24 hours at 50° C., images were output until the toner end sensor detected the end, i.e. until the amount of the toner becomes empty. The toner replenishing performance was evaluated based on the following criteria.

A: No changes in the toner replenishing performance until the toner end

B: Almost no changes in the toner replenishing performance until the toner end

C: Erroneously detect the toner end several times during the outputting, but recovered and replenished until the toner end (Practical Level)

D: Detect the toner end at the beginning or middle of the outputting and did not recover after shaking the toner container (Not practical level)

<White Dots>

An A3 size solid image was formed for evaluation and was evaluated by visual observation based on the following criteria.

A: Excellent quality with the occurrence of less than 3 white dots

B: Good quality with the occurrence of 3 to 5 white dots.

C: The occurrence of white dots of 6 or more and not less than 50

D: Not practical level of quality with the occurrence of 50 or more white dots

<Image Density>

An A3 size solid image was formed for evaluation and was evaluated by visual observation based on the following criteria.

A: Excellent quality and no changes in the image density

B: Good quality and no changes in the image density

C: Slight changes in the image density

D: Dramatic changes in the image density

<Image Streaks>

An A3 size solid image was formed for evaluation and was evaluated by visual observation based on the following criteria.

A: Excellent quality with no occurrence of the streak

B: Good quality with occurrences of less than 3 of the streaks

C: Occurrences of 3 or more and less than 5 of the streaks

D: Not practical level of quality with occurrences of 5 or more of the streaks

<Gloss Non-Uniformity>

An A3 size solid image was formed for evaluation and was evaluated by visual observation based on the following criteria.

A: Excellent quality with no occurrences of gloss non-uniformimity

B: Good quality with almost no occurrences of gloss non-uniformity

C: Difference in the gloss level between the beginning and end of the A3 size solid image D: Not practical level of quality and large difference in the gloss level between the begging and the end of the A3 size solid image

TABLE 1

| | Friction coefficient | Diameter of releasing agent (μm) | Volume-average particle diameter of toner (μm) | Number percentage of particles having diameter of 0.7 μm to 2.0 μm | Average particle diameter of additives (nm) | Toner replenishing performance | White dots | Image density | Image streaks | Gloss Non-uniformity |
|---|---|---|---|---|---|---|---|---|---|---|
| Example 1 | 0.15 | 0.10-1.2 | 7.2 | 15.0 | 350 | A | B | A | A | A |
| Example 2 | 0.15 | 0.10-1.2 | 7.3 | 10.0 | 23 | A | B | A | A | A |
| Example 3 | 0.15 | 0.10-1.2 | 7.3 | 10.0 | 200 | A | A | A | A | A |
| Example 4 | 0.35 | 0.03-1.0 | 6.0 | 5.0 | 120 | A | A | A | A | A |
| Example 5 | 0.20 | 0.05-0.08 | 5.2 | 2.5 | 50 | A | A | A | A | A |
| Comp. Ex. 1 | 0.40 | 0.15-1.8 | 5.5 | 5.0 | 100 | D | D | D | A | B |
| Comp. Ex. 2 | 0.10 | 0.03-1.0 | 7.3 | 3.0 | 50 | C | A | A | D | D |

As apparent from the results shown in Table 1, in Examples 1 to 5, there were no problems in the toner replenishing performance, white dot occurrence, image density, image streaks and non-uniformed gloss since the dynamic friction coefficient of the toner is in the range of 0.15 to 0.35 and the dispersion diameter of the releasing agent is in a range of 0.03 μm to 2.0 μm.

In Comparative Example 1, the problems occurred in the toner replenishing performance, white dots and image density since the dynamic friction coefficient of the toner is in out of range of 0.15 to 0.35 and the dispersion diameter of the releasing agent is out of range of 0.03 μm to 2.0 μm. Furthermore, in Comparative Example 2, problems occurred in the toner replenishing performance, streak image and non-uniformed gloss since the dynamic friction coefficient of the toner is out of the range of 0.15 to 0.35.

Next, the toner production method according to the dissolution suspension method will be further described below.

EXAMPLE 6

<Synthesis of Organic Particulate Emulsion>

To a reaction vessel provided with a stirrer and a thermometer, 683 parts of water, 11 parts of sodium salt of the sulfuric acid ester of methacrylic acid ethylene oxide adduct (ELEMINOL RS-30, manufactured by Sanyo Chemical Industries, Ltd.), 83 parts of styrene, 83 parts of methacrylic acid, 110 parts of butyl acrylate, and 1 part of ammonium persulphate were poured, and stirred at 400 rpm for 15 minutes to obtain a white emulsion. The white emulsion was heated, the temperature in the system was raised to 75° C. and the reaction was performed for 5 hours. Next, 30 parts of an aqueous solution of 1% ammonium persulphate was added, and the reaction mixture was matured at 75° C. for 5 hours to obtain an aqueous dispersion liquid of a vinyl resin or copolymer of styrene-methacrylic acid-butyl acrylate-sodium salt of the sulfuric acid ester of methacrylic acid ethylene oxide adduct. This aqueous solution was taken as "particulate dispersion liquid 1".

The volume-average particle diameter of the "particulate dispersion liquid 1" measured by a laser diffraction particle size distribution analyzer (LA-920, manufactured by SHIMADZU Corp.) was 105 nm. After drying part of the "particulate dispersion liquid 1" and isolating the resin, the glass transition temperature (Tg) of the resin was 59° C., and the mass average molecular mass was 150,000.

<Preparation of Aqueous Phase>

To 990 parts of water, 99 parts of the particulate dispersion liquid 1, 35 parts of a 48.5% aqueous solution of sodium dodecyl diphenylether disulfonic acid (ELEMINOL MON-7, manufactured by Sanyo Chemical Industries, Ltd.) and 70 parts of ethyl acetate were mixed and stirred together to obtain a milky liquid. This was taken as "aqueous phase 1".

<Synthesis of Low-Molecular-Mass Polyester>

In a reaction vessel equipped with a condenser tube, a stirrer, and a nitrogen inlet tube, 229 parts of bisphenol A ethylene oxide dimolar adduct, 529 parts of bisphenol A propylene oxide trimolar adduct, 208 parts of terephthalic acid, 46 parts of adipic acid and 2 parts of dibutyltin oxide were placed, and the reaction was performed under normal pressure at 230° C. for 8 hours, and the reaction was further performed under reduced pressures of 10 mmHg to 15 mmHg for 5 hours, then 44 parts of anhydrous trimellitic acid was placed to the reaction vessel, and the reaction was performed at 180° C. under normal pressure for 1.7 hours to obtain "low-molecular-mass polyester 1".

The "low-molecular-mass polyester 1" was taken as low-molecular-mass polyester. The "low-molecular-mass polyester 1" had a number average molecular mass (Mn) of 2,400, a mass average molecular mass (Mw) of 6,700, a peak top molecular mass of 5,000, a glass transition temperature (Tg) of 43° C. and an acid value of 25.

<Synthesis of Intermediate Polyester>

In a reaction vessel equipped with a condenser tube, a stirrer, and a nitrogen inlet tube, 682 parts of bisphenol A ethylene oxide dimolar adduct, 81 parts of bisphenol A propylene oxide dimolar adduct, 283 parts of terephthalic acid, 22 parts of anhydrous trimellitic acid, and 2 parts of dibutyl tin oxide were placed, and the reaction was performed under normal pressure at 230° C. for 9 hours, and then the reaction was further performed under reduced pressures of 10 mmHg to 15 mmHg for 5 hours to obtain an "intermediate polyester 1".

The "intermediate polyester 1" had a number average molecular mass (Mn) of 2,200, a mass average molecular mass (Mw) of 9,700, a glass transition temperature (Tg) of 55° C., an acid value of 0.5 and a hydroxyl group value of 51.

Next, 410 parts of the intermediate polyester 1, 89 parts of isophorone diisocyanate, and 500 parts of ethyl acetate were placed in a reaction vessel equipped with a condenser tube, a stirrer, and a nitrogen inlet tube, and the reaction was performed at 100° C. for 5 hours to obtain a "prepolymer 1" having an isocyanate group. The free isocyanate % by mass of the "prepolymer 1" was 1.53%.

<Synthesis of Ketimine>

Into a reaction vessel equipped with a stirrer and a thermometer, 170 parts of isophorone diamine and 75 parts of methyl ethyl ketone were poured, and the reaction was performed at 50° C. for 5 hours to obtain a "ketimine compound 1". The amine value of the "ketimine compound 1" was 418.

<Synthesis of Masterbatch>

To 1200 parts of water, 540 parts of carbon black (Printex 35, DBP inhale oil value=42 ml/100 mg. pH=9.5, manufactured by Degussa) and 1,200 parts of the low-molecular-mass polyester resin prepared in Example 6 were added, and mixed in Herschel mixer (manufactured by Mitsui Mining Co., Ltd.) then the mixture was kneaded at 150° C. for 30 minutes using two rollers, extrusion cooled and crushed with a pulverizer to obtain masterbatch 1 (BK).

<Preparation of Oil Phase>

Into a vessel equipped with a stirrer and thermometer, 378 parts of the "low-molecular-mass polyester 1", 110 parts of carnauba wax, and 947 parts of ethyl acetate were poured, and the temperature was raised to 80° C. with stirring, maintained at 80° C. for 4 hours and cooled to 30° C. in 1 hour. Next, 500 parts of the masterbatch 1 (BK) and 500 parts of ethyl acetate were poured into the vessel and mixed for 1 hour to obtain an "initial material solution 1".

To a vessel, 1,324 parts of the "initial material solution 1" were transferred, and the carbon black and the wax were dispersed 3 times using a bead mill (Ultra Visco Mill, manufactured by AIMEX CO., LTD.) under the conditions of liquid feed rate lkg/hr, disk circumferential speed of 6 m/s, 0.5 mm zirconia beads packed to 80% by volume. Next, 1324 parts of 65% ethyl acetate solution of the "low-molecular-mass polyester 1" was added and dispersed once by the bead mill under the above-noted conditions to obtain a "pigment and wax dispersion liquid 1".

The solids concentration of the "pigment and wax dispersion liquid 1" heated at a temperature of 130° C. for 30 minutes was 50%.

<Emulsification and Solvent Removal>

In a vessel, 749 parts of the "pigment and wax dispersion liquid 1", 115 parts of the "prepolymer 1" and 2.9 parts of the "ketimine compound 1" were placed and mixed at 5,000 rpm for 2 minutes by a TK homomixer (manufactured by TOKUSHU KIKA KOGYO CO., LTD.), then 1,200 parts of the aqueous phase 1 were added to the vessel and mixed in the TK homomixer at a rotation speed of 12,000 rpm for 30 minutes to obtain an "emulsion slurry 1".

The "emulsion slurry 1" was placed in a vessel equipped with a stirrer and a thermometer, then the solvent was removed at 35° C. for 7 hours and the product was matured at 45° C. for 4 hours to obtain each of "dispersion slurry 1".

On the way of removal of the solvent, the sample was transferred into the TK HOMO MIXER, stirred therein at 12,000 rpm for 40 minutes and thereby yielded a toner having irregularly shaped partciles.

<Rinsing and Drying>

After filtering 100 parts of the "dispersion slurry 1" under reduced pressure, rinsing and drying of the filter cake were performed as follows:

(1) 100 parts of ion exchange water were added to the filter cake, mixed in a TK homomixer at a rotation speed of 12,000 rpm for 10 minutes and filtered.

(2) 100 parts of 10% sodium hydroxide were added to the filter cake of (1), mixed in a TK homomixer at a rotation speed of 12,000 rpm for 30 minutes and filtered.

(3) 100 parts of 10% hydrochloric acid were added to the filter cake of (2), mixed in a TK homomixer at a rotation speed of 12,000 rpm for 10 minutes and filtered.

(4) 300 parts of iron exchange water were added to the filter cake of (3), mixed in a TK homomixer at a rotation speed of 12,000 rpm for 10 minutes and filtered twice to obtain a "filter cake 1".

The "filter cake 1" was dried in a circulating air dryer at 45° C. for 48 hours and then sieved through a sieve of 75 μm mesh. Further, to 100 parts of the obtained particles, 0.6 parts of CCA (E-84, metal salicylic acid, manufactured by Orient Chemical Industries, Ltd.) were mixed in in Herschel mixer at 1,000 rpm, then mixed in Q-type mixer (manufactured by Mitsui Mining Co., Ltd.) at 5,500 rpm to adhere the CCA onto the surface of the toner, thereby obtaining a "base toner 1".

The obtained toner had a volume-average particle diameter of 4.8 μm and number-average particle diameter of 3.9 μm.

<Addition of External Additives>

To 100 parts of the obtained baser toner, 0.7 parts of hydrophobized titanium oxide having a volume-average diameter of primary particles shown in Table 2 and were mixed in the Henschel mixer to obtain a toner 1 (Black).

Furthermore, the yellow toner, magenta toner and cyan toner were obtained in the same manner as the black toner, except for using 1000 parts of yellow pigment (disazo yellow pigment C.I. pigment Yellow 180), 540 parts of magenta pigment (naphtol pigment C.I. Pigment Red 269), and 400 parts of cyan pigment (copper phthalocyanine C.I. Pigment Blue 15:3), respectively, instead of a carbon black used in the base toner 1.

EXAMPLE 7

<Synthesis of Organic Particulate Emulsion>

To a reaction vessel provided with a stirrer and a thermometer, 683 parts of water, 11 parts of sodium salt of the sulfuric acid ester of methacrylic acid ethylene oxide adduct (ELEMINOL RS-30, manufactured by Sanyo Chemical Industries, Ltd.), 80 parts of styrene, 83 parts of methacrylic acid, 110 parts of butyl acrylate, 12 parts of butyl thioglycollate and 1 part of ammonium persulphate were poured, and stirred at 400 rpm for 15 minutes to obtain a white emulsion. The white emulsion was heated, the temperature in the system was raised to 75° C. and the reaction was performed for 5 hours. Next, 30 parts of an aqueous solution of 1% ammonium persulphate was added, and the reaction mixture was matured at 75° C. for 5 hours to obtain an aqueous dispersion liquid of a vinyl resin or copolymer of styrene-methacrylic acid-butyl acrylate-sodium salt of the sulfuric acid ester of methacrylic acid ethylene oxide adduct. This aqueous solution was taken as "particulate dispersion liquid 2".

The volume-average particle diameter of primary particles of the "particulate dispersion liquid 2" measured by a laser diffraction particle size distribution analyzer (LA-920, manufactured by SHIMADZU Corp.) was 120 nm. After drying part of the "particulate dispersion liquid 2" and isolating the resin, the glass transition temperature (Tg) of the resin was 42° C., and the mass average molecular mass was 30,000.

"Toner 2" was obtained in the same manner as the Example 6 except for using the "particulate dispersion liquid 2" instead of the "particulate dispersion liquid 1" of Example 6.

EXAMPLE 8

<Synthesis of Organic Particulate Emulsion>

To a reaction vessel provided with a stirrer and a thermometer, 670 parts of water, 11 parts of sodium salt of the sulfuric acid ester of methacrylic acid ethylene oxide adduct (ELEMINOL RS-30, manufactured by Sanyo Chemical Industries, Ltd.), 101 parts of styrene, 83 parts of methacrylic acid, 90 parts of butyl acrylate, 12 parts of butyl thioglycollate and 1 part of ammonium persulphate were poured, and stirred at 400 rpm for 15 minutes to obtain a white emulsion. The white emulsion was heated, the temperature in the system was raised to 75° C. and the reaction was performed for 5 hours. Next, 30 parts of an aqueous solution of 1% ammonium persulphate was added, and the reaction mixture was matured at 75° C. for 5 hours to obtain an aqueous dispersion liquid of a vinyl resin or copolymer of styrene-methacrylic acid-butyl acrylate-sodium salt of the sulfuric acid ester of methacrylic acid ethylene oxide adduct. This aqueous solution was taken as "particulate dispersion liquid 3".

The volume-average particle diameter of the "particulate dispersion liquid 3" measured by a laser diffraction particle size distribution analyzer (LA-920, manufactured by SHIMADZU Corp.) was 110 nm. After drying part of the "particulate dispersion liquid 3" and isolating the resin, the glass transition temperature (Tg) of the resin was 78° C., and the mass average molecular mass was 25,000.

"Toner 3" was obtained in the same manner as the Example 6 except for using the "particulate dispersion liquid 3" instead of the "particulate dispersion liquid 1" of Example 6.

EXAMPLE 9

<Synthesis of Organic Particulate Emulsion>

To a reaction vessel provided with a stirrer and a thermometer, 683 parts of water, 11 parts of sodium salt of the sulfuric acid ester of methacrylic acid ethylene oxide adduct (ELEMINOL RS-30, manufactured by Sanyo Chemical Industries, Ltd.), 78 parts of styrene, 83 parts of methacrylic acid, 115 parts of butyl acrylate, 2 parts of butyl thioglycollate and 1 part of ammonium persulphate were poured, and stirred at 400 rpm for 20 minutes to obtain a white emulsion. The white emulsion was heated, the temperature in the system was raised to 75° C. and the reaction was performed for 6 hours. Next, 30 parts of an aqueous solution of 1% ammonium persulphate was added, and the reaction mixture was matured at 75° C. for 5 hours to obtain an aqueous dispersion liquid of a vinyl resin or copolymer of styrene-methacrylic acid-butyl acrylate-sodium salt of the sulfuric acid ester of methacrylic acid ethylene oxide adduct. This aqueous solution was taken as "particulate dispersion liquid 4".

The volume-average particle diameter of the "particulate dispersion liquid 4" measured by a laser diffraction particle size distribution analyzer (LA-920, manufactured by SHIMADZU Corp.) was 115 nm. After drying part of the "particulate dispersion liquid 4" and isolating the resin, the glass transition temperature (Tg) of the resin was 51° C., and the mass average molecular mass was 100,000.

"Toner 4" was obtained in the same manner as the Example 6 except for using the "particulate dispersion liquid 4" instead of the "particulate dispersion liquid 1" of Example 6 and using hydrophobized silica having a volume-average diameter of primary particles shown in Table 2.

EXAMPLE 10

<Synthesis of Organic Particulate Emulsion>

To a reaction vessel provided with a stirrer and a thermometer, 683 parts of water, 11 parts of sodium salt of the sulfuric acid ester of methacrylic acid ethylene oxide adduct (ELEMINOL RS-30, manufactured by Sanyo Chemical Industries, Ltd.), 68 parts of styrene, 93 parts of methacrylic acid, 115 parts of butyl acrylate and 1 part of ammonium persulphate were poured, and stirred at 400 rpm for 15 minutes to obtain a white emulsion. The white emulsion was heated, the temperature in the system was raised to 75° C. and the reaction was performed for 5 hours. Next, 30 parts of an aqueous solution of 1% ammonium persulphate was added, and the reaction mixture was matured at 75° C. for 5 hours to obtain an aqueous dispersion liquid of a vinyl resin or copolymer of styrene-methacrylic acid-butyl acrylate-sodium salt of the sulfuric acid ester of methacrylic acid ethylene oxide adduct. This aqueous solution was taken as particulate dispersion liquid 5.

The volume-average particle diameter of the particulate dispersion liquid 5 measured by a laser diffraction particle size distribution analyzer (LA-920, manufactured by SHIMADZU Corp.) was 90 nm. After drying part of the particulate dispersion liquid 5 and isolating the resin, the glass transition temperature (Tg) of the resin was 56° C., and the mass average molecular mass was 150,000.

<Preparation of Oil Phase>

"Initial material solution 2" was obtained in the same manner as Example 6 except for using 100 parts of ester wax instead of 110 parts of carnauba wax used for the preparation of oil phase of Example 6. To a vessel, 1,324 parts of the "initial material solution 2" were transferred, and the carbon black and the wax were dispersed 3 times using a bead mill (Ultra Visco Mill, manufactured by AIMEX CO., LTD.) under the conditions of liquid feed rate 1 kg/h, disk circumferential speed of 6 m/sec, 0.5 mm zirconia beads packed to 80% by volume. Next, 1324 parts of 65% ethyl acetate solution of the "low-molecular-mass polyester 1" was added and dispersed once by the bead mill under the above-noted conditions to obtain a "pigment and wax dispersion liquid 2". The solids concentration of the "pigment and wax dispersion liquid 2" heated at a temperature of 130° C. for 30 minutes was 50%.

"Toner 5" was obtained in the same manner as the Example 6 except for using the "particulate dispersion liquid 5" instead of the "particulate dispersion liquid 1" of Example 6, using the "pigment and wax dispersion liquid 2" instead of the "pigment and wax dispersion liquid 1" of Example 6, and using hydrophobic silica having a volume-average diameter of primary particles shown in Table 2 as external additives instead of hydrophobized titanium oxide used in Example 6.

EXAMPLE 11

<Preparation of Emulsion Slurry>

In a vessel, 753 parts of the "pigment and wax dispersion liquid 1", 154 parts of the "prepolymer 1" and 3.8 parts of the "ketimine compound 1" were placed and mixed at 5,000 rpm for 1 minute by a TK homomixer (manufactured by TOKUSHU KIKA KOGYO CO., LTD.), then 1,200 parts of the "aqueous phase 1" were added to the vessel and mixed in the TK homomixer at a rotation speed of 13,000 rpm for 20 minutes to obtain an "emulsion slurry 2".

"Toner 6" was obtained in the same manner as Example 6 except for using the "emulsion slurry 2" instead of the "emulsion slurry 1" of Example 6. Further, on the way of removal of the solvent, the sample was transferred into the TK Homomixer, stirred therein at 12,500 rpm for 40 minutes and thereby yielded a toner having irregularly shaped partciles.

EXAMPLE 12

<Synthesis of Low-Molecular-Mass Polyester>

In a reaction vessel equipped with a condenser tube, a stirrer, and a nitrogen inlet tube, 196 parts of bisphenol A propylene oxide dimolar adduct, 553 parts of bisphenol A ethylene oxide dimolar adduct, 210 parts of terephthalic acid, 79 parts of adipic acid and 2 parts of dibutyltin oxide were placed, and the reaction was performed under normal pressure at 230° C. for 8 hours, and the reaction was further performed under reduced pressures of 10 mmHg to 15 mmHg for 5 hours, then 26 parts of anhydrous trimellitic acid was placed to the reaction vessel, and the reaction was performed at 180° C. under normal pressure for 2 hours to obtain a "low-molecular-mass polyester 2".

The "low-molecular-mass polyester 2" had a number average molecular mass (Mn) of 2,400, a mass average molecular mass (Mw) of 6,200, a peak top molecular mass of 5,200, a glass transition temperature (Tg) of 43° C. and an acid value of 15.

"Toner 7" was obtained in the same manner as Example 10 except for using the "low-molecular-mass polyester 2" instead of the "low-molecular-mass polyester 1" of Example 10. Further, on the way of removal of the solvent, the sample was transferred into the TK Homomixer, stirred therein at 13,000 rpm for 40 minutes and thereby yielded a toner having irregularly shaped partciles.

Next, similar to Examples 1 to 5 and Comparative Examples 1 to 2, for each toner of Examples 6 to 12, the dynamic friction coefficient of the toner, the dispersion diameter of the releasing agent, the volume-average particle diameter of the toner, and the the number percentage of toner particles having a particular diameter of 0.7 μm to 2.0 μm were measured. The results are shown in Table 2.

Next, similar to Examples 1 to 5 and Comparative Examples 1 to 2, various characteristics of the toner of Examples 6 to 12 were analyzed. The results are also shown in Table 2.

TABLE 2

| | Friction coefficient | Diameter of releasing agent (μm) | Volume-average particle diameter of toner (μm) | Number percentage of particles having diameter of 0.7 μm to 2.0 μm | Average particle diameter of additives (nm) | Toner replenishing performance | White dots | Image density | Image streaks | Gloss Non-uniformity |
|---|---|---|---|---|---|---|---|---|---|---|
| Example 6 | 0.20 | 0.05-0.5 | 4.8 | 7.0 | 140 | Good | Good | Good | Good | Good |
| Example 7 | 0.22 | 0.12-0.92 | 5.4 | 6.5 | 120 | Good | Good | Good | Good | Good |
| Example 8 | 0.28 | 0.04-0.10 | 6.5 | 3.2 | 90 | Good | Good | Good | Good | Good |
| Example 9 | 0.18 | 0.12-1.42 | 6.2 | 9.5 | 60 | Good | Good | Good | Good | Good |
| Example 10 | 0.34 | 1.2-1.4 | 3.8 | 4.2 | 280 | Good | Good | Good | Good | Good |
| Example 11 | 0.15 | 0.22-0.97 | 5.6 | 1.5 | 30 | Good | Good | Good | Good | Good |
| Example 12 | 0.29 | 0.03-1.5 | 4.0 | 7.2 | 100 | Good | Good | Good | Good | Good |

As apparent from the results shown in Table 2, in Examples 6 to 12, there were no problems in the toner replenishing performance, white dot occurrence, image density, image streaks and non-uniformed gloss since the dynamic friction coefficient of the toner is in the range of 0.15 to 0.35 and the dispersion diameter of the releasing agent is in a range of 0.03 μm to 2.0 μm, therefore it was confirmed advantages in Examples 6 to 12.

What is claimed is:

1. An image forming apparatus comprising:

a latent electrostatic image bearing member;

a charging unit configured to uniformly charge a surface of the image bearing member;

an exposing unit configured to form a latent electrostatic image on the surface of the charged image bearing member;

a developing unit configured to develop the latent electrostatic image formed on the surface of the image bearing member by supplying a toner to form a visible image;

a transferring unit configured to transfer the visible image formed on the surface of the image bearing member to a recording medium;

a fixing unit configured to fix the visible image on the recording medium by application of at least one of heat and pressure;

a cleaning unit configured to clean a residual toner on the image bearing member; and a toner replenishing device configured to replenish the toner to the developing unit, wherein the toner replenishing device comprises a pump configured to supply the toner and a toner container arranged in conjunction with the pump, and wherein the toner is contained in the toner container, and comprises a binder resin, a colorant and a releasing agent and has a dynamic friction coefficient of 0.15 to 0.35.

2. The image forming apparatus according to claim 1, wherein the image bearing member and at least one selected from the group consisting of the charging unit, the developing unit and the cleaning unit are formed in an integral construction as a process cartridge, the process cartridge being provided detachably in a main body of the image forming apparatus.

3. The image forming apparatus according to claim 1, wherein the colorant is a chromatic colorant.

4. The image forming apparatus according to claim 1, wherein the toner replenishing device further comprises an air supply unit configured to fluidize the toner contained in the toner container.

5. The image forming apparatus according to claim 4, wherein the air supply unit of the toner replenishing device is a blowing air pump.

6. The image forming apparatus according to claim 1, wherein the toner container comprises a toner outlet and a flexible main body of which volume reduction rate is 60% or more.

7. The image forming apparatus according to claim 1, wherein:

the toner container is configured to be mounted to a main body of an image forming apparatus, the toner replenishing device is configured so that a driven part of the pump side is brought into driving engagement with a drive part of the image forming apparatus side when the toner container is mounted to the main body of the image forming apparatus, and the toner makes contact with a part of the driven part by the driving engagement.

8. The image forming apparatus according to claim 1, wherein the releasing agent in the toner has a dispersion diameter of 0.03 μm to 2.0 μm.

9. The image forming apparatus according to claim 1, wherein the toner has a volume-average particle diameter of 3 μm to 8μm and the content of toner particles having a particle diameter of 0.7 μm to 2.0 μm is 10% by number or less when measured by a flow-type particle image analyzer.

10. The image forming apparatus according to claim 1, wherein the toner comprises fine particles having a volume-average diameter of primary particles of 30nm to 300nm on the surface thereof.

11. The image forming apparatus according to claim 10, wherein the fine particles are at least one of organic fine particles and inorganic fine particles.

12. The image forming apparatus according to claim 1, wherein the toner is obtained by:

dissolving or dispersing toner materials containing at least an active hydrogen group-containing compound and a polymer reactive with the active hydrogen group-containing compound in an organic solvent to prepare a toner solution;

emulsifying and dispersing the toner solution in an aqueous medium to prepare a dispersion thereof;

reacting the active hydrogen group-containing compound and the polymer reactive to the active hydrogen group-containing compound in the aqueous medium to granulate adhesive base materials; and removing the organic solvent.

13. The image forming apparatus according to claim 1, wherein the toner container comprises a container main body formed of a flexible member of a resin film.

14. The image forming apparatus according to claim 1, wherein the toner container comprises a toner outlet and an engaging portion at which the toner outlet and a tubular body are engaged and the engagement is maintained.

15. The image forming apparatus according to claim 1, wherein the toner replenishing device comprises a toner transfer path which is formed between a developing unit of the image forming apparatus and the toner container and supplies the toner from the toner container to the developing unit through the toner transfer path by means of an air stream.

16. The image forming apparatus according to claim 1, wherein the toner replenishing device is configured so that the pump comprises, as main members, a fixed hollow elastic member and a rigid coil-shaped axis making contact with an inner wall of the hollow elastic member and a mixture fluid of the toner discharged from the toner container and air is transferred by rotating the axis to prevent the mixture fluid from flowing back.

17. The image forming apparatus according to claim 1, wherein the toner replenishing device is configured to facilitate the fluidization of the toner by giving a shake or shock to the toner container containing the toner.

* * * * *